US009629770B1

(12) United States Patent
Dyer et al.

(10) Patent No.: US 9,629,770 B1
(45) Date of Patent: Apr. 25, 2017

(54) PORTABLE TRANSFER BOARD AND METHOD

(71) Applicants: Joseph T. Dyer, Atlanta, GA (US); Michael L. Wach, Alpharetta, GA (US)

(72) Inventors: Joseph T. Dyer, Atlanta, GA (US); Michael L. Wach, Alpharetta, GA (US)

( * ) Notice: Subject to any disclaimer, the term of this patent is extended or adjusted under 35 U.S.C. 154(b) by 491 days.

(21) Appl. No.: 13/721,009

(22) Filed: Dec. 19, 2012

Related U.S. Application Data

(60) Provisional application No. 61/630,824, filed on Dec. 19, 2011.

(51) Int. Cl.
*A61G 7/10* (2006.01)

(52) U.S. Cl.
CPC ..... *A61G 7/103* (2013.01)

(58) Field of Classification Search
CPC . A45F 4/06; A45F 4/08; A47C 17/645; A47C 16/005; A61G 1/00; A61G 1/003; A61G 1/013; A61G 1/044; A61G 1/048; A61G 7/1025; A61G 7/103; A61G 7/1038; A61G 2203/76; B60P 3/04; F16L 21/002; A47F 5/01
USPC ..... 5/81.1 R, 81.1 HS, 625, 627, 110, 111, 5/114
See application file for complete search history.

(56) References Cited

U.S. PATENT DOCUMENTS 1,257,445 A * 2/1918 Arntzen ..... A61G 1/04 296/20
1,264,652 A * 4/1918 Hunt ..... 5/627
1,903,536 A * 4/1933 Skinner ..... 5/627
2,417,378 A * 3/1947 Robinson ..... A61G 1/003 5/627
2,614,266 A * 10/1952 Smith ..... 5/627
2,759,239 A * 8/1956 Snyder ..... A61G 19/00 27/27
3,348,245 A * 10/1967 Shindler ..... 5/629
3,574,871 A * 4/1971 Greene ..... 5/627
3,797,051 A * 3/1974 Evans ..... A61G 1/013 16/327
3,867,045 A 2/1975 Beals
3,867,730 A * 2/1975 Wright ..... 5/42.1
4,538,846 A 9/1985 Alexander
(Continued)

FOREIGN PATENT DOCUMENTS

FR EP 2074977 A1 * 7/2009 ..... A61G 7/103

OTHER PUBLICATIONS

Ableware, "Foldable Wheel Opens New Doors for Wheelchair Users", "http://www.maddak.com/foldable_wheelchair_wheel.php?osCsid=eb0c640a559a81dfc1de40a9e0ecc503", Sep. 19, 2011.

*Primary Examiner* — Nicholas Polito
(74) *Attorney, Agent, or Firm* — Thomas | Horstemeyer LLP; Jason M. Perilla

(57) ABSTRACT

A portable transfer board can facilitate moving a person having limited mobility, for example a person in a wheelchair transferring himself or herself into or out of a wheelchair. The portable transfer board can be transported in a compact configuration and placed in a transfer configuration on an as-needed basis. For example, a user or caregiver can tote the portable transfer board in a backpack, in a compartment on a wheelchair, or on his or her person. When needed for transfer, the user or caregiver can reconfigure the transfer board, so that at least one dimension is lengthened, and deploy the transfer board.

20 Claims, 12 Drawing Sheets

(56) References Cited

U.S. PATENT DOCUMENTS

| | | | | | |
|---|---|---|---|---|---|
| 4,776,721 | A | | 10/1988 | Lange | |
| 4,783,862 | A | * | 11/1988 | Murphy | A61G 1/013 224/157 |
| 4,827,958 | A | | 5/1989 | Cantwell et al. | |
| 4,840,362 | A | | 6/1989 | Bremer et al. | |
| 4,987,621 | A | * | 1/1991 | Brantman | A61G 7/103 193/35 R |
| 5,152,016 | A | * | 10/1992 | Becker | A61G 7/103 193/35 R |
| 5,190,056 | A | * | 3/1993 | Hull | A61B 6/0442 128/870 |
| 5,193,233 | A | * | 3/1993 | Miller | A61G 7/103 193/35 R |
| 5,322,492 | A | | 6/1994 | Pearson | |
| 5,435,024 | A | * | 7/1995 | Capshaw | 5/417 |
| 5,580,069 | A | | 12/1996 | Trejo et al. | |
| 5,611,594 | A | | 3/1997 | Findlay | |
| 5,617,962 | A | | 4/1997 | Chen | |
| 5,802,632 | A | * | 9/1998 | Campbell | A61G 7/103 198/321 |
| 5,897,471 | A | | 4/1999 | Multanen et al. | |
| 6,079,178 | A | | 6/2000 | Fisher | |
| 6,227,757 | B1 | | 5/2001 | Delouvee et al. | |
| 6,554,356 | B1 | | 4/2003 | Crose | |
| 6,883,817 | B2 | | 4/2005 | Chu | |
| 7,357,761 | B2 | | 4/2008 | Mattox | |
| 8,096,520 | B2 | | 1/2012 | Sohn et al. | |
| 2003/0106155 | A1 | * | 6/2003 | Arai | A61G 1/00 5/627 |
| 2004/0222617 | A1 | * | 11/2004 | Darling, III | 280/651 |
| 2005/0177943 | A1 | * | 8/2005 | Sawatzky | 5/627 |
| 2010/0170036 | A1 | * | 7/2010 | Shirandami | A61G 7/103 5/81.1 R |
| 2012/0084916 | A1 | * | 4/2012 | Flannery | A47C 21/08 5/426 |
| 2012/0117926 | A1 | * | 5/2012 | Miller | 53/473 |
| 2013/0074259 | A1 | * | 3/2013 | Snep | A47G 9/062 5/420 |

* cited by examiner

*DETAIL A*

ASSEMBLY VIEW - SHOCK CORD DEPICTED IN RELAXED (5A) OR TAUT (5B) STATE FOR TRANSPORT OR SELF-ASSEMBLY (SMALL CATCH HIDDEN INSIDE TUBE.)

ASSEMBLY VIEW - SHOCK CORD DEPICTED WITH TRANSFER BOARD IN FULLY ASSEMBLED STATE (JOINTS IN COMPRESSION)

ALTERNATIVE ASSEMBLY VIEW - SHOCK CORD DEPICTED WITH TRANSFER BOARD IN FULLY ASSEMBLED STATE (JOINTS IN COMPRESSION)

PORTABLE TRANSFER BOARD AND METHOD

CROSS-REFERENCE TO RELATED APPLICATION

This application claims priority benefit, under 35 U.S.C. §119(e), of U.S. Provisional Patent Application No. 61/630,824 filed Dec. 19, 2011 by Joseph T. Dyer et al., titled "Portable transfer board," which is incorporated herein by reference in its entirety.

TECHNICAL FIELD

The present technology relates generally to systems for facilitating transferring a person having limited mobility, such as a wheelchair-bound person moving himself or herself between a wheelchair and an automobile, and more specifically to portable transfer boards that can be transported in a compact configuration and deployed in another configuration.

BACKGROUND

The number of people who suffer from some form of mobility impairment is large and growing larger every day. The causes of reduced mobility extend from the acute (sprains, fractures, problem pregnancies) to the chronic, including such causes as spinal cord injury, neuromuscular diseases, and stroke. Persons with impaired mobility face a wide variety of problems when confronting routine activities of daily living. Notable among these challenges is the simple act of transferring between a wheelchair and a bed, shower, toilet, automobile or other location.

The abstract of an article authored by H. Gellman, I. Sie, and R. L. Waters in *Clinical Orthopaedics and Related Research* (CORR), dated August 1988, and entitled "*Late Complications of the Weight-Bearing Upper Extremity in the Paraplegic Patient*," characterizes such challenges as follows: "Paraplegic patients rely almost exclusively on their upper extremities for weight-bearing activities such as transfers and wheelchair propulsion. Eighty-four paraplegic patients whose injury level was T2 or below and who were at least one year from spinal cord injury were screened for upper extremity complaints. Fifty-seven (67.8%) had complaints of pain in one or more areas of their upper extremities. The most common complaints were shoulder pain and/or pain relating to carpal tunnel syndrome. Twenty-five (30%) complained of shoulder pain during transfer activities. Symptoms were found to increase with time from injury. As the long-term survival of spinal cord injured patients continues to improve, an increased awareness of the complications of the weight-bearing upper extremity is necessary to keep these patients functioning in society."

Many people use an assistive device commonly called a "transfer board" as a transfer aid to facilitate mobility. In the conventional art, these generally are flat, rigid planks of wood or plastic that are placed between the wheelchair and a desired transfer location, such as a bed or automobile seat. The boards are usually between about two feet and three feet in length (between about 60 cm and 92 cm in length), about six to eight inches wide (between about 15 cm and 20 cm in width), and about an inch (about 2.54 cm) or less thick.

The transfer board is smooth and supports the weight of the person as he or she slides from one location to the other. The board reduces the strain on the person's upper extremities and in many cases provides a degree of independence not otherwise possible. Transfer boards are also very useful to personal-care attendants who must transfer patients from bed to wheelchair. Without such an assistive device, the caretakers risk injury from lifting or shifting the patient's body weight.

Common transfer boards are simple wooden planks that are usually rectangular but may be shaped with cutouts to accommodate wheelchair configurations. Specialized versions can feature multi-part assemblies with a sliding seat mounted on a support rail. Such conventional transfer boards generally have at least one seamless member that extends all the way between opposing ends of the transfer board. Accordingly, conventional transfer boards typically lack portability. Handicapped people often find packing such a conventional transfer board during travel impracticable, whether they are routinely moving around town in taxis or vacationing overseas. A wheelchair-bound person traveling with a conventional transfer board is akin to toting a skate board or snowboard everywhere—highly undesirable. In addition to being bulky, these solid-wood or compound boards often weigh several pounds. Coupled with the numerous other mobility challenges, many handicapped people just stay home, to the detriment of society, their caretakers and loved ones, and themselves.

In view of the foregoing discussion of representative deficiencies in the art, need is apparent for improved technologies for transferring people who are wheelchair bound or otherwise handicapped. Moreover, such people experience long-felt need for relief. Need is apparent for a transfer board with improved portability. Need exists for a transfer board that is collapsible or that can be readily assembled and disassembled on an as-needed basis. Need exists for a compact, reconfigurable transfer board that is lightweight. Need exists for a transfer board offering an improved strength-to-weight ratio. Need exists for a transfer board offering an improved strength-to-size ratio. Need exists for a transfer board that wheelchair-bound people can transport, assemble, configure, deploy, and/or use by themselves. Need exists for a transfer board that distributes or directs the force of a user's weight away from bony tissue. Need further exists for a transfer board that can be toted in a backpack attached to the back of a wheelchair or worn by the person. Need further exists for a transfer board that can be toted inside a package having a maximum dimension substantially smaller than the length of the transfer board when the transfer board is configured for transferring a person. Need further exists for a transfer board that can be stowed on a wheelchair, such as in a compartment or pouch attached to a wheelchair. Need further exists for a transfer board that can be carried by airliners (for example in connection with complying with a government or other policy or regulation), ships, taxis, hotels, rental-car firms, and perhaps as an option offered with the purchase of a wheelchair. A technology addressing one or more such needs, or some other related shortcoming in the art, would promote mobility of people whose mobility is otherwise compromised.

SUMMARY

The present invention can support a person having limited mobility when transferring from one place to another nearby place, for example a person in a wheelchair transferring into or out of a wheelchair. In one aspect of the present invention, a portable transfer board can be readily transported in a compact configuration and readily reconfigured into a transfer configuration, and back to a compact configuration, on an as-needed basis.

The discussion of transferring technology and transfer boards presented in this summary is for illustrative purposes only. Various aspects of the present invention may be more clearly understood and appreciated from a review of the following detailed description of the disclosed embodiments and by reference to the figures and claims. Other aspects, systems, processes, methods, features, advantages, benefits, and objects of the present invention will become apparent to one of ordinary skill in the art upon examination of the following detailed description and the accompanying figures. It is intended that all such aspects, systems, processes, methods, features, advantages, benefits, and objects are to be included within this description, are to be within the scope of the present invention, and are to be protected by the accompanying claims.

Figure 1:
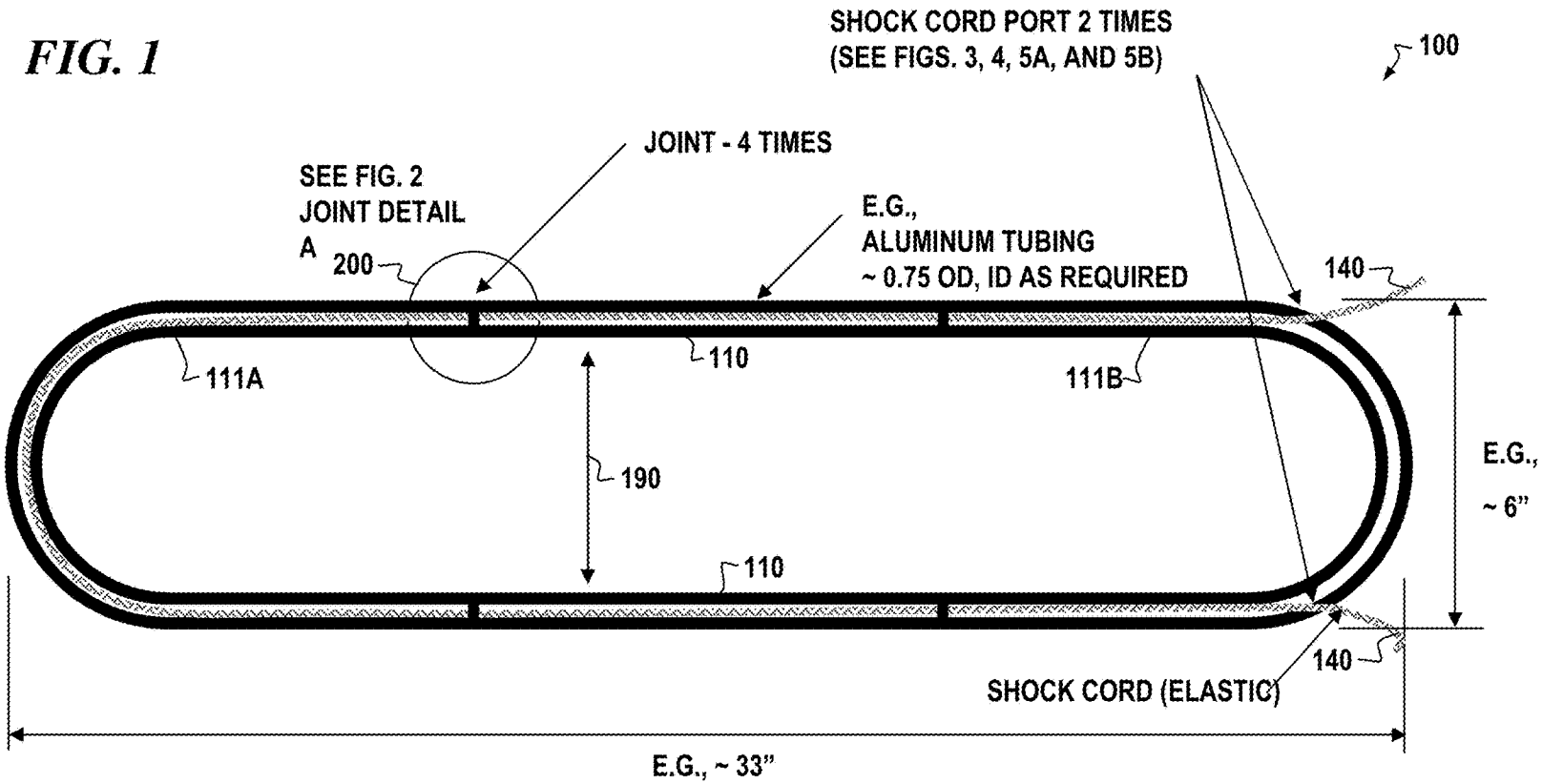
FIG. 1 is an illustration of a portable transfer board 100 in an assembled state in accordance with certain exemplary embodiments of the present invention.

Many aspects of the present invention can be better understood with reference to the above figures. The elements and features shown in the figures are not necessarily to scale, emphasis instead being placed upon clearly illustrating principles of exemplary embodiments of the present invention. Moreover, certain dimensions may be exaggerated to help visually convey such principles. In the figures, reference numerals designate like or corresponding, but not necessarily identical, elements throughout the several views.

DETAILED DESCRIPTION OF EXEMPLARY EMBODIMENTS

Although the following detailed description contains many specifics for the purpose of illustration, a person of ordinary skill in the art will appreciate that many variations and alterations to the following details are within the scope of the invention. Very narrow and specific examples are used to illustrate particular embodiments; however, the invention described in the claims is not intended to be limited to only these examples, but rather includes the full scope of the attached claims. Accordingly, the following preferred embodiments of the invention are set forth without any loss of generality to, and without imposing limitations upon the claimed invention. Further, in the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention. The embodiments shown in the Figures and described here may include features that are not included in all specific embodiments. A particular embodiment may include only a subset of all of the features described, or a particular embodiment may include all of the features described.

The leading digit(s) of reference numbers appearing in the Figures generally corresponds to the Figure number in which that component is first introduced, such that the same reference number is used throughout to refer to an identical component which appears in multiple Figures. Signals and connections may be referred to by the same reference number or label, and the actual meaning will be clear from its use in the context of the description.

The present invention supports a portable or compact system for transferring a person of limited mobility between two locations, such as between a car and a wheelchair.

Figure 7A:
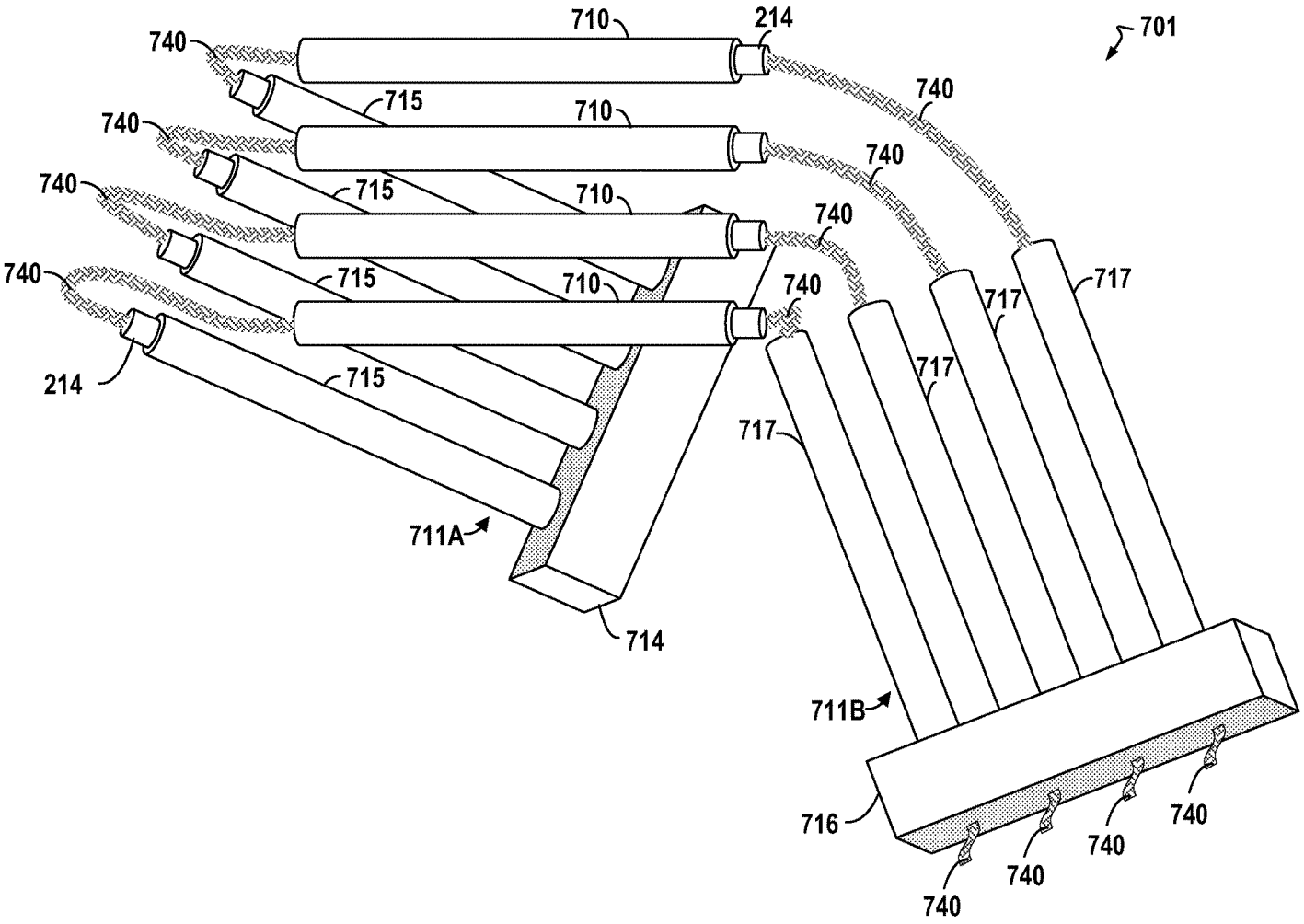
FIG. 7A is a perspective illustration of another portable transfer board 701 in a first progressive state of assembly in accordance (near fully collapsed in a transport configuration) with certain exemplary embodiments of the present invention.
Figure 7B:
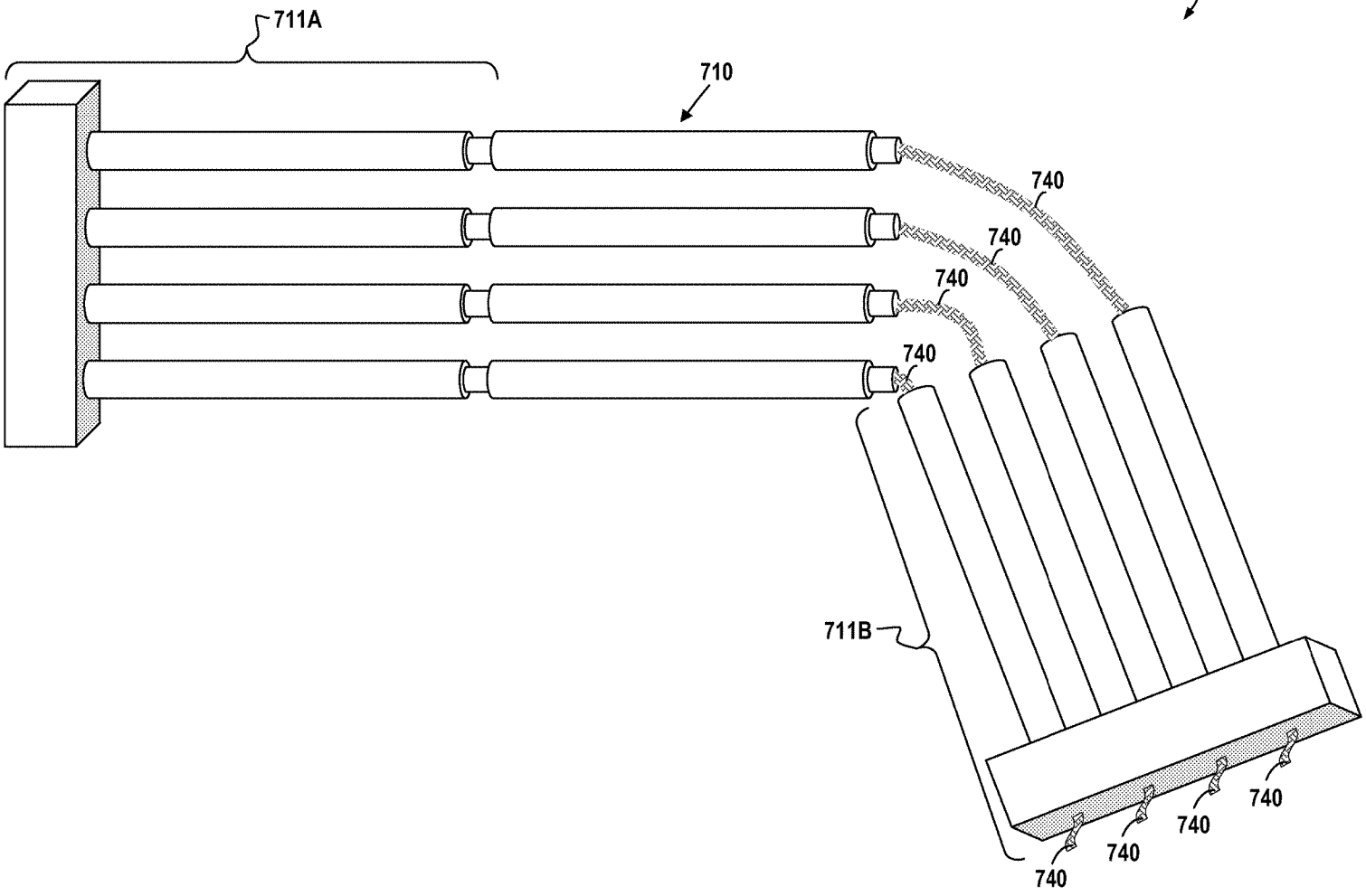
FIG. 7B is a perspective illustration of portable transfer board 701 in a second progressive state of assembly in accordance with certain exemplary embodiments of the present invention.
Figure 7C:
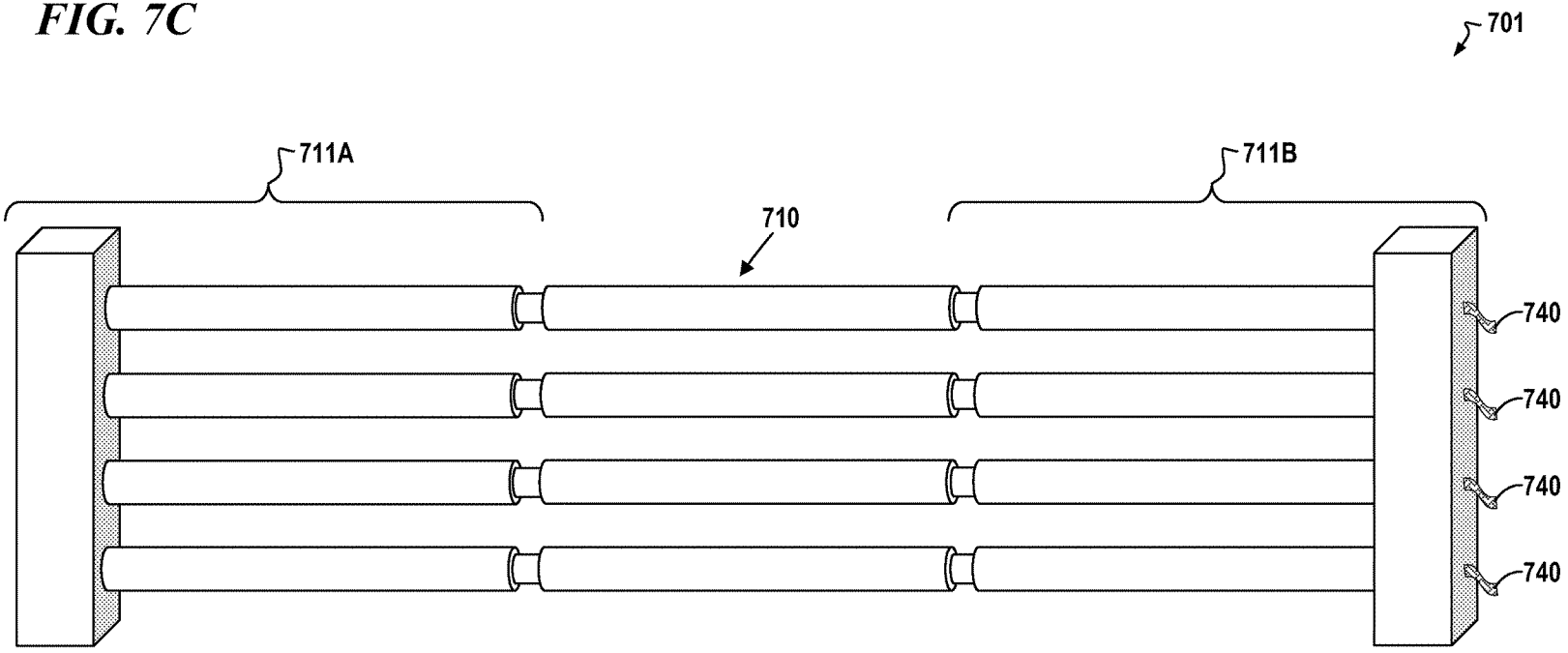
FIG. 7C is a perspective illustration of portable transfer board 701 in a third progressive state of assembly in accordance with certain exemplary embodiments of the present invention.
Figure 7D:
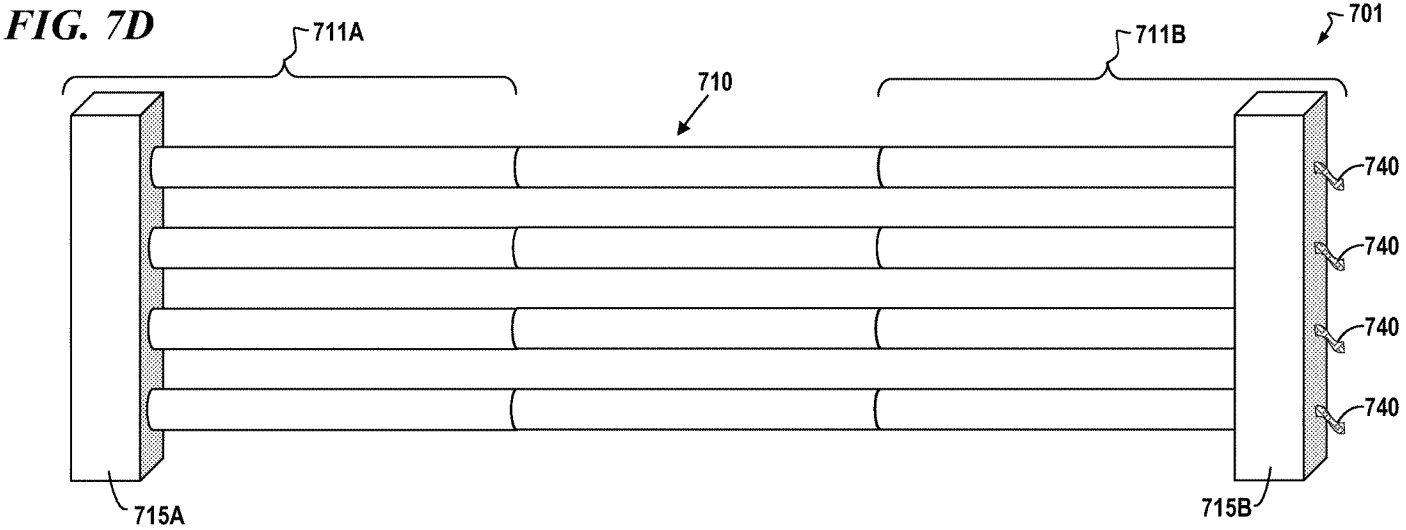
FIG. 7D is a perspective (substantially plan-view) illustration of portable transfer board 701 in a fourth progressive state of assembly (fully assembled in a transfer configuration) in accordance with certain exemplary embodiments of the present invention.
Figure 7E:
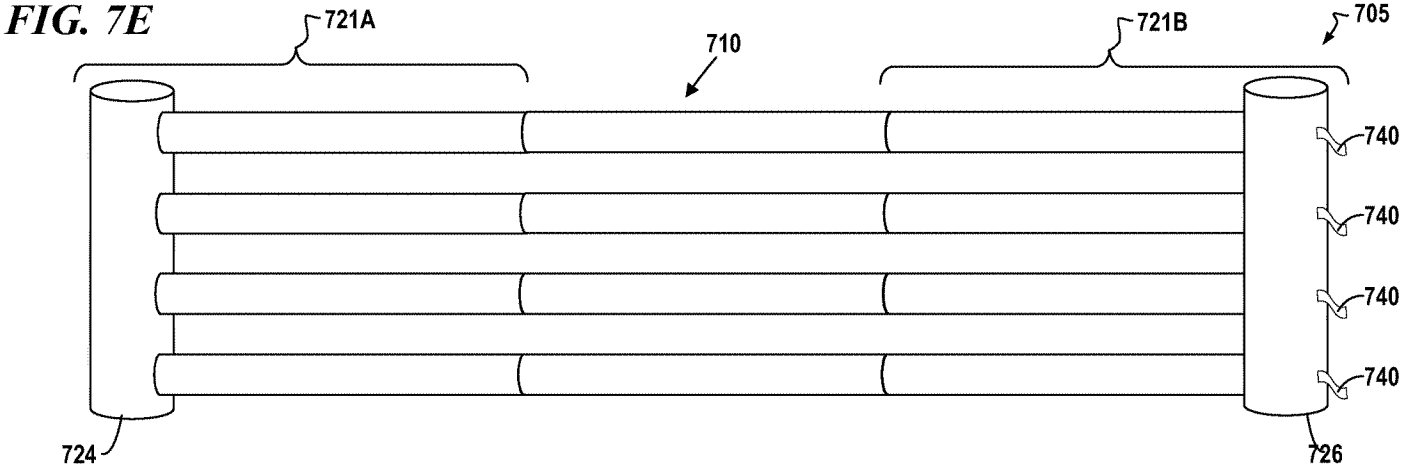
FIG. 7E is a perspective (substantially plan-view) illustration of another portable transfer board 705 in a final progressive state of assembly in accordance with certain exemplary embodiments of the present invention.
Figures 8A, 8B, 8C, 8D, 8E, 8F:
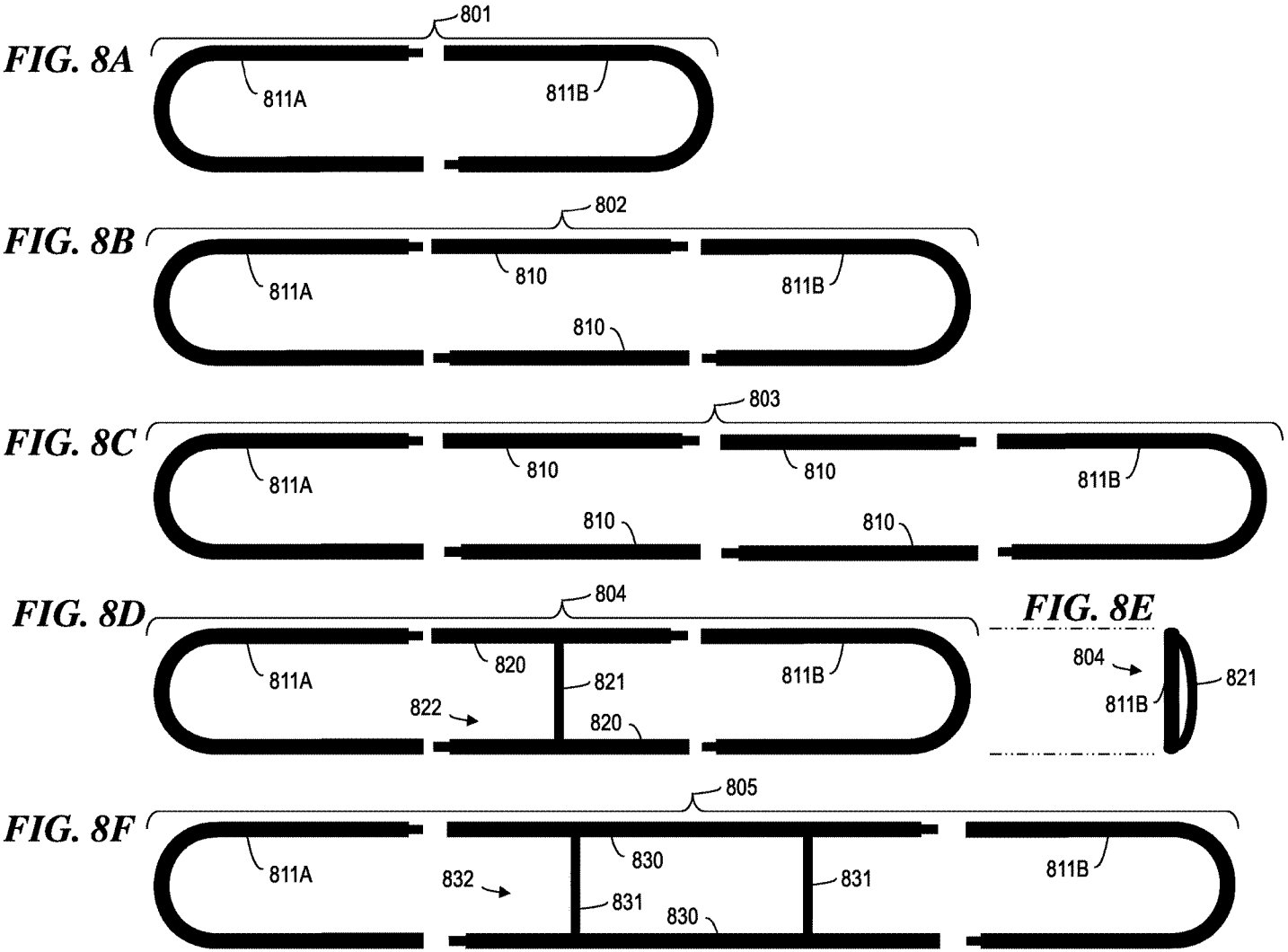
FIG. 8A is a plan-view illustration of another portable transfer board 801 in a first progressive state of assembly in accordance (disassembled for collapse into a transport configuration), according to embodiments of the present invention.
FIG. 8B is a plan-view illustration of another portable transfer board 802 in a first progressive state of assembly in accordance (disassembled for collapse into a transport configuration), according to embodiments of the present invention.
FIG. 8C is a plan-view illustration of another portable transfer board 803 in a first progressive state of assembly in accordance (disassembled for collapse into a transport configuration), according to embodiments of the present invention.
FIG. 8D is a plan-view illustration of another portable transfer board 804 in a first progressive state of assembly in accordance (disassembled for collapse into a transport configuration), according to embodiments of the present invention.
FIG. 8E is a side-view illustration of portable transfer board 804 in a second progressive state of assembly in accordance (assembled for use in a transfer configuration), according to embodiments of the present invention.
FIG. 8F is a plan-view illustration of another portable transfer board 806 in a first progressive state of assembly in accordance (disassembled for collapse into a transport configuration), according to embodiments of the present invention.
Figures 9A, 9B, 9C, 9D, 9E:
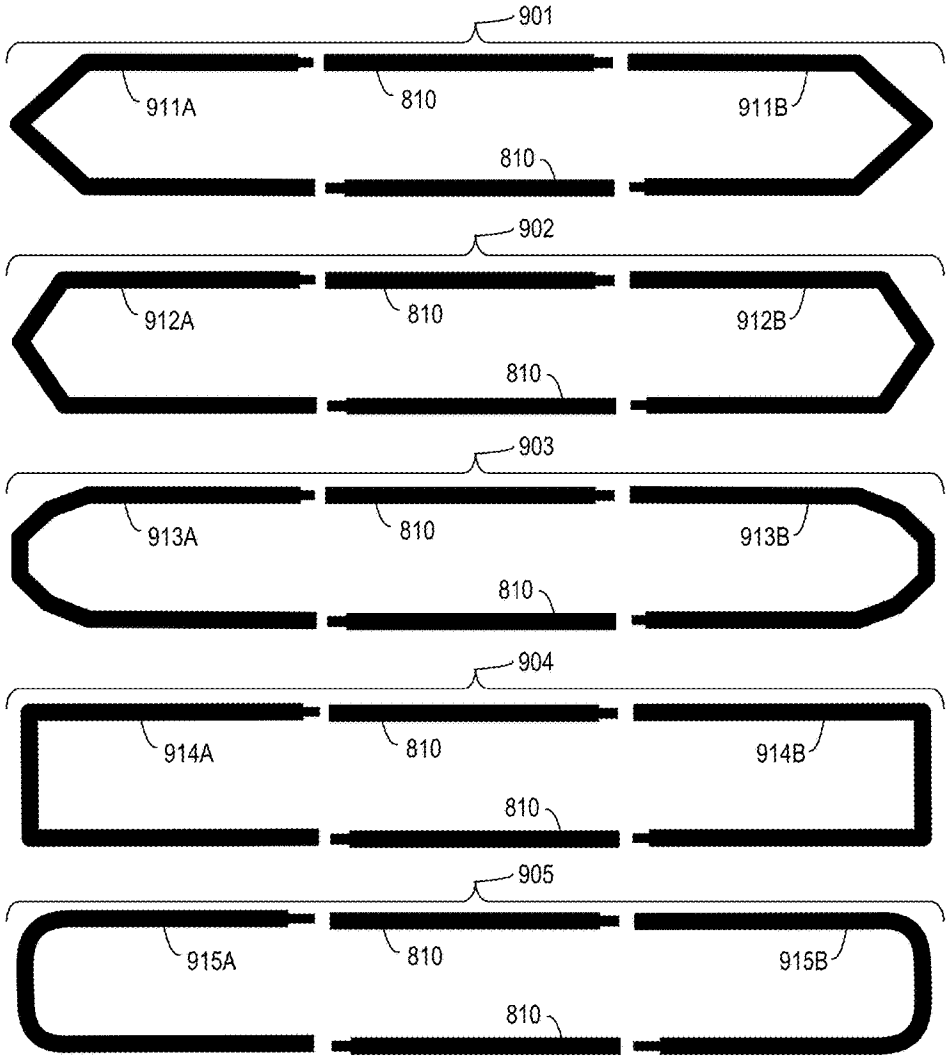
FIG. 9A is a plan-view illustration of another portable transfer board 901 in a first progressive state of assembly in accordance (disassembled for collapse into a transport configuration), according to embodiments of the present invention.
FIG. 9B is a plan-view illustration of another portable transfer board 902 in a first progressive state of assembly in accordance (disassembled for collapse into a transport configuration), according to embodiments of the present invention.
FIG. 9C is a plan-view illustration of another portable transfer board 903 in a first progressive state of assembly in accordance (disassembled for collapse into a transport configuration), according to embodiments of the present invention.
FIG. 9D is a plan-view illustration of another portable transfer board 904 in a first progressive state of assembly in accordance (disassembled for collapse into a transport configuration), according to embodiments of the present invention.
FIG. 9E is a plan-view illustration of another portable transfer board 905 in a first progressive state of assembly in accordance (disassembled for collapse into a transport configuration), according to embodiments of the present invention.

The present invention will be discussed more fully hereinafter with reference to FIGS. 1-9D, which provide additional information about representative or illustrative embodiments of the present invention. FIGS. 1, 2, 3, 4, 5A, and 5B illustrate one representative transfer board. FIGS. 5C and 6 illustrate variations on the representative transfer board illustrated in FIGS. 1, 2, 3, 4, 5A, and 5B. FIGS. 7A, 7B, 7C, and 7D illustrate reconfiguration of another representative transfer board 701. (FIG. 7A illustrates an alternative embodiment 701 of a portable transfer board in a partially dissembled state for stowing in a backpack or other transportation means. FIGS. 7B and 7C illustrate an alternative embodiment 701 of a portable transfer board in a partially assembled state. FIG. 7D illustrates an alternative embodiment 701 of a portable transfer board in a fully assembled state, for transferring a person.) FIG. 7E illustrates another representative portable transfer board 705—this alternative embodiment shown in a fully assembled state, for transferring a person. FIG. 8A illustrates another representative transfer board 801. FIG. 8B illustrates another representative transfer board 802. FIG. 8C illustrates another representative transfer board 803. FIGS. 8D and 8E illustrate another representative transfer board 804. FIG. 8F illustrates another representative transfer board 806. FIG. 9A illustrates another representative transfer board 901. FIG. 9B illustrates another representative transfer board 902. FIG. 9C illustrates another representative transfer board 903. FIG. 9D illustrates another representative transfer board 904.

The present invention can be embodied in many different forms and should not be construed as limited to the embodiments set forth herein; rather, these embodiments are provided so that this disclosure will be thorough and complete, and will fully convey the scope of the invention to those having ordinary skill in the art. Furthermore, all "examples," "embodiments," and "exemplary embodiments" given herein are intended to be non-limiting, and among others supported by representations of the present invention.

This document includes sentences, paragraphs, and passages (some of which might be viewed as lists) disclosing alternative components, elements, features, functionalities, usages, operations, steps, etc. for various embodiments of the present invention. Unless clearly stated otherwise, all such lists, sentences, paragraphs, passages, and other disclosures are not exhaustive, are not limiting, are provided in the context of describing representative examples and variations, and are among others supported by various embodiments of the present invention. Moreover, the items in such lists and other disclosed alternatives are not necessarily mutually exclusive and thus may be overlapping. A single embodiment of the present invention or a single element can include multiple items from a disclosed set of alternatives, whether the set is disclosed herein using the conjunction "or," in the form of a Markush group, as a list, or otherwise enumerated. Those of ordinary skill in the art having benefit of this disclosure will appreciate that the present invention is not constrained by any such lists, examples, or alternatives. Moreover, the inclusion of lists, examples, embodiments, and the like will help educate and guide those of ordinary skill in the art to practice many more implementations and instances of the present invention without undue experimentation, all of which are intended to be within the scope of the claims.

This disclosure includes figures and discussion in which features and elements of certain embodiments may be organized into units or components, for example functional blocks, subsystems, modules, or the like. Further, certain processes and methods may be organized into steps. Such organization is intended to enhance readability and to teach the reader about working principles of the present invention and about making and using an abundance of embodiments of the present invention. The organization is not intended to force any rigid divisions or partitions that would limit the present invention. In practice, the flexibility of the present invention supports dispersing, rearranging, or grouping functionalities, elements, and features in many different ways. The inclusion of an element or function in one block, module, or subsystem versus another can be substantially arbitrary in many instances, with the divisions being soft and readily redrawn using this rich disclosure supported by ordinary skill. Accordingly, functional blocks, modules, subsystems, and the like can be combined, divided, repartitioned, redrawn, moved, reorganized, rearranged, or otherwise altered without deviating from the scope and spirit of the present invention. This is not to say that certain disclosed organizations and combinations are not novel or are obvious. The way certain features of the present invention relate to and interact with one another is new. Accordingly, combinations, arrangements, or organizations disclosed herein can represent innovative subject matter.

FIG. 1 is a plan-view illustration of a portable transfer board 100 in an assembled state configured for transfer of a person in accordance with certain exemplary embodiments of the present invention.

In the illustrated embodiment, the portable transfer board 100 includes two U-shaped segments of tubing 111A and 111B, one at each end of the portable transfer board. Two straight segments of tubing 110 extend between the two U-shaped segments of tubing. In an exemplary embodiment, the straight segments 110 and the U-shaped segments 111A and 111B are formed of a strong aluminum alloy, such as 2024 or 6061-type aluminum alloys. In some embodiments, the diameter is typically in a range of one-half inch to one inch (1.27 cm to 2.54 cm), with three-fourth-inch (1.9 cm)-diameter tubing being suitable for many applications. In certain embodiments, the tubing may include titanium for further reduction in weight and/or increase in strength. In certain embodiments, the tubing may include a non-metallic material (such as polymer tubing, tubing made of fiberglass-reinforced epoxy or other polymer, or polymer coating on metal tubing). In certain embodiments, the tubing comprises a composite material such as fiberglass-reinforced (or reinforcement that includes Kevlar®, aramid, carbon or other fibers) epoxy or other polymer material. In certain embodiments, the tubing includes fiberglass, aramid fiber, or carbon fiber.

In one embodiment, the tubing is 6061-T6 aluminum alloy, with an outer diameter of approximately 0.75 inches (1.9 cm), and an internal diameter of approximately 0.620 inches (1.57 cm), with a wall thickness of approximately 0.065 inches (0.165 cm). Such tubing, which is widely commercially available, can be utilized as stock for the two straight pieces as well as for the two U-shaped segments.

The two U-shaped segments can be formed by bending the tubing utilizing typical tubing techniques and equipment (such as the bending tools used to manually bend metal conduit used for electrical wiring) that are well known to those of ordinary skill in the art—without any special processes or equipment. In some embodiments, the U-shaped segments are formed with a bend radius of approximately three inches (about 7.6 cm), resulting in a width of approximately six inches (about 15.2 cm) for the portable transfer board. Other embodiments may incorporate different bend radii for narrower or wider transfer boards, such as may be appropriate for youth models, for example. In certain embodiments, each of the U-shaped segments has two curved corners with a straight portion in between such as shown in FIG. 9E, as an alternative to one continuous circular bend of constant curvature as illustrated in FIG. 1. In certain embodiments of the configuration of FIG. 9E, each U-shaped segment 951A and 951B has a width of approximately six inches (about 15.2 cm) and two curved corners, each having a bend radius of approximately one to two inches (about 2.5 cm to about 5 cm), for example.

In some embodiments, the overall length of the portable transport board 100, as illustrated in FIG. 1, is approximately 33 inches (about 84 cm). Various models of similar embodiments have lengths in a range of about two to four feet (about 61 cm to about 122 cm). In the illustrated embodiment, the portable transfer board comprises the two end sections that are each approximately 11 inches (about 28 cm) in length (measured in a direction perpendicular to the width) or ⅓ the overall length and the center section (comprising two straight pieces 110 of tubing) that is approximately 11 inches (about 28 cm) or ⅓ the overall length (not including the narrowed ends or nipples or ferrules 214 (see FIG. 2) used to join the center sections to the end sections 111A and 111B).

Other embodiments may be divided into more or fewer segments, as illustrated in FIGS. 8A-8F. For example, in certain portable transfer board embodiments, the two U-shaped segments (e.g., 811A and 811B) mate together (see FIG. 8A), without having straight tubing segments extending between. In certain embodiments, four straight segments (e.g., 810 as shown in FIG. 8C) extend between the two U-shaped segments (e.g., 811A and 811B), i.e. with two straight segments 810 on one side butted end-to-end, and two other straight segments 810 for the other side also butted end-to-end. Thus, the center straight segments (such as 110 or 810) can either be eliminated or further divided, each into more two or more pieces.

In some embodiments, an elastic shock cord 140 (or other elastic rope such as are commonly called bungee cord and the like, all of which are generically termed "shock cord" in the present description) extends through the lumen or center open region of a plurality of the segments of the portable transfer board 100 and exits through two shock-cord ports. As will be discussed in further detail below, the elastic shock cord 140 aids configuring the portable transfer board between a compact, transportation configuration and a length-extended user-transfer configuration such as shown in FIG. 1. In other words, the shock cord helps change the portable transfer board from a folded stowed state (where the cord holds the pieces side-by-side next to one another) to a state suitable for supporting and moving a transferee (where the cord is extended and in tension and holds the pieces end-to-end mated with one another). FIGS. 7A-7D illustrate a manual- or self-assembly process that a user would use for changing a portable transfer board 701 incorporating shock-cord technology from a folded state (convenient for carrying portable transfer board 701 in a backpack or the like) to an extended rigid state (useful for helping transfer the user between a wheelchair and a bed, for example). (Although FIGS. 7A-7D illustrate a portable transfer board 701 of an alternative embodiment, the self-assembly process of FIGS. 7A-7D applies to the portable transfer board 100 embodiment of FIG. 1.) Beyond facilitating transfer-board reconfiguration and assembly, the elastic shock cord 140 can maintain the portable transport board in a state of compression during use as a transfer-assistance device, not only avoiding accidental separation of the tubing segments, but also increasing structural integrity and strength. That is, the shock cord 140 can become a structural element of the portable transport board 100, not only maintaining assembly, but also increasing load-bearing strength.

In use, a transferee can sit on the portable transfer board 100 illustrated in FIG. 1 so bony prominences are relatively protected by being in the open space 190 between the two sides 110 and extending from one end of the length to the opposite end. Many conventional transfer boards that use a wooden-plank approach may apply force to the region surrounding the transferee's tail bone that is often relatively void of protective soft tissue, thereby risking injury or promoting a pressure ulcer. In contrast, the transferee can sit on and across the portable transfer board illustrated in FIG. 1 (e.g., with his or her legs extending to the outer sides of side segments 110) so that the bony region of his or her buttocks is between the rails (e.g., side segments 110) and thus less susceptible to injury.

Figure 2:
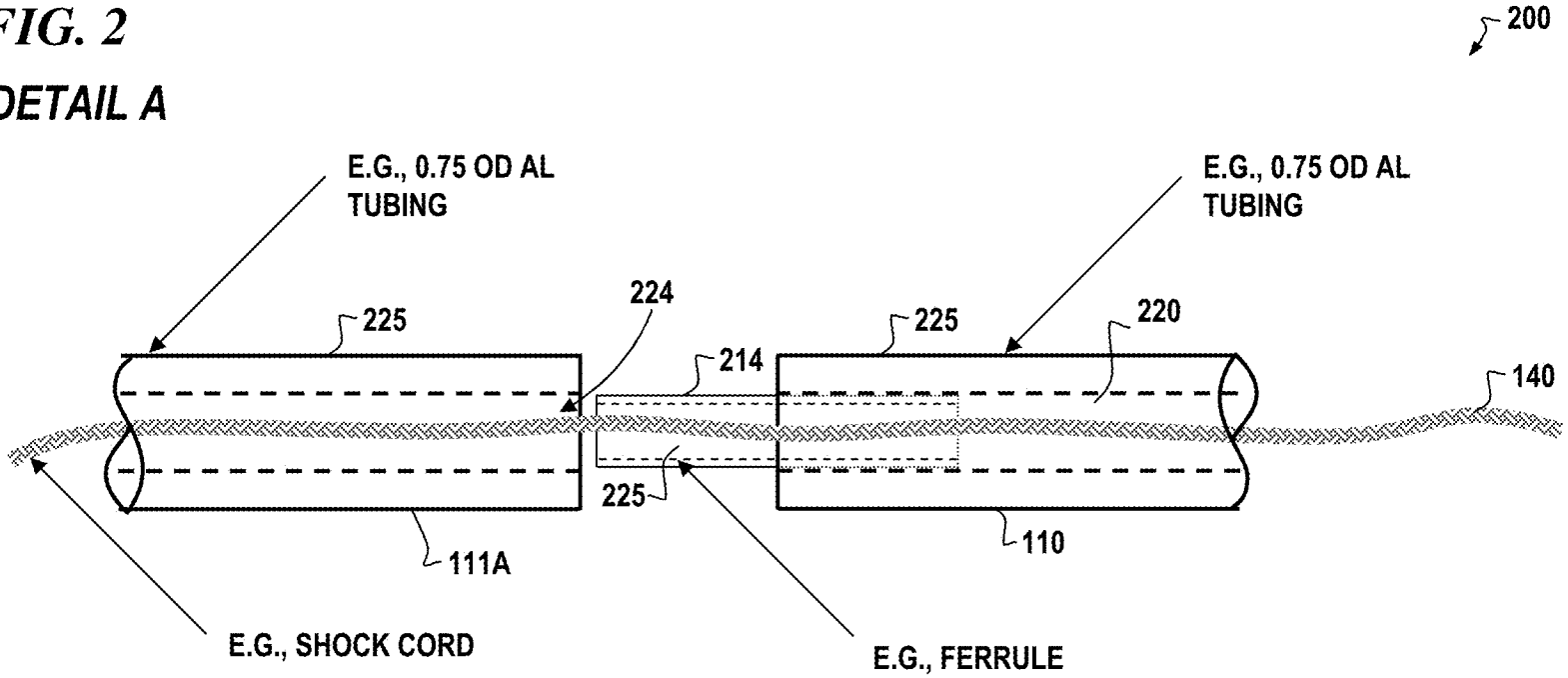
FIG. 2 is a detail illustration of a joint 200 of portable transfer board 100 in a disassembled state in accordance with certain exemplary embodiments of the present invention.

Turning now to FIG. 2, this figure illustrates detail of an exemplary joint 200 of a portable transfer board 100 in a disassembled state according to certain embodiments of the present invention. That is, the joint 200 illustrated in FIG. 2 is disconnected or unmated, but aligned for connection, assembly, or mating. The joint 200 illustrated in FIG. 2 is applicable to the portable transfer board embodiment that FIG. 1 illustrates and will be discussed in that context and with reference to FIG. 1. This joint is also applicable to some versions of all the other embodiments described herein.

As illustrated in FIG. 1, the portable transfer board 100 comprises four joints. In some embodiments, a ferrule 214 at each joint extends into each of the two hollow tubing segments 225 that are butted together. In some embodiments, ferrule 214 is press-fit, crimped, welded or glued permanently into the segment on one side of the joint (the left-hand segment in FIG. 2, for example) In some embodiments, the ferrules 214 are made of metal tubing, such as those discussed above, or of a composite material comprising aramid, carbon, or fiberglass, for example. In one embodiment, the ferrules 214 are made of 6061-T6 aluminum alloy tubing having an outer diameter of approximately 0.625 inches (about 1.59 cm) and an internal diameter of lumen 215 of approximately 0.495 inches (about 1.26 cm), with a wall thickness of approximately 0.065 inches (about 0.165 cm). In one embodiment, the ferrules are made of 6061-T6 aluminum alloy tubing having an outer diameter of approximately 0.625 inches (about 1.59 cm) and an internal diameter of lumen 220 of approximately one-quarter of an inch (about 0.635 cm), five-sixteenths of an inch (about 0.794 cm), or three-eighths of an inch (about 0.953 cm). The ferrules can be turned down so that they fit inside the outer tubing. Alternatively, the outer tubing can be counter bored at the ends to accept the ferrules.

In one embodiment, the ferrules are turned down so that they have an outer diameter that is about one- to four-thousandths of an inch (25.4 to 101.6 microns) smaller than the inner diameter of the outer tubing. In some such embodiments, one ferrule end is glued into one outer tubing, for example using an adhesive or locking compound, while the other end is free to slide into and out of the abutting outer tubing.

In one embodiment, one ferrule end has an interference fit suitable for press fitting into one outer tubing, while the opposite ferrule end is free to slide into and out of the abutting outer tubing. For example, the ferrules can be permanently attached to the U-shaped segments via press fit, and the ends of the straight segments can be counter bored to provide a gap of approximately 0.001 to 0.004 inches (25.4 to 101.6 microns).

In one embodiment, the protruding end of each permanently attached ferrule 214 is shaped to facilitate mating with the interior lumen 220 of the abutting tubing piece (e.g., 110) during assembly of the portable transfer board. That ferrule end can be bullet shaped, radiused, or beveled with one angle or with compound angles, for example. In certain embodiments, that ferrule end is tipped with a plastic polymer insert, so shaped, that helps guide the ferrule into the abutting member. The plastic insert, which can be viewed as a hollow nose cone, can be made of a polymer having a lower coefficient of friction than aluminum, for example polyoxymethylene (POM), also known as acetal, polyacetal, and polyformaldehyde and marketed by DuPont® under the trademark "DELRIN®"; ultra-high-molecular-weight (UHMW) polyethylene, or a fluoropolymer or other suitable material. The plastic insert, which has a hole through which the shock cord passes, can be press fit into the ferrule, for example.

In other embodiments, rather than use a separate ferrule, the end of the segment (e.g., segment 110 of FIG. 2) on one side of the joint 200 is turned down or squeezed to a nipple shape that resembles the ferrule 214 using well known aluminum-forming techniques, such that a single unitary piece of tubing functions to have a socket at one end and a nipple at the opposite end that fits into a like-sized socket of another piece.

The shock cord 140 extends through the joints not only to facilitate self alignment and assembly, but also to maintain compression between the abutting outer tubing segments during use of the portable transfer board. The shock cord 140 keeps the tubing pieces of the portable transfer board 100 from separating as the transferee slides along the portable transfer board. The shock cord 140 further enhances the portable transfer board's static load-bearing capabilities.

Figure 3:
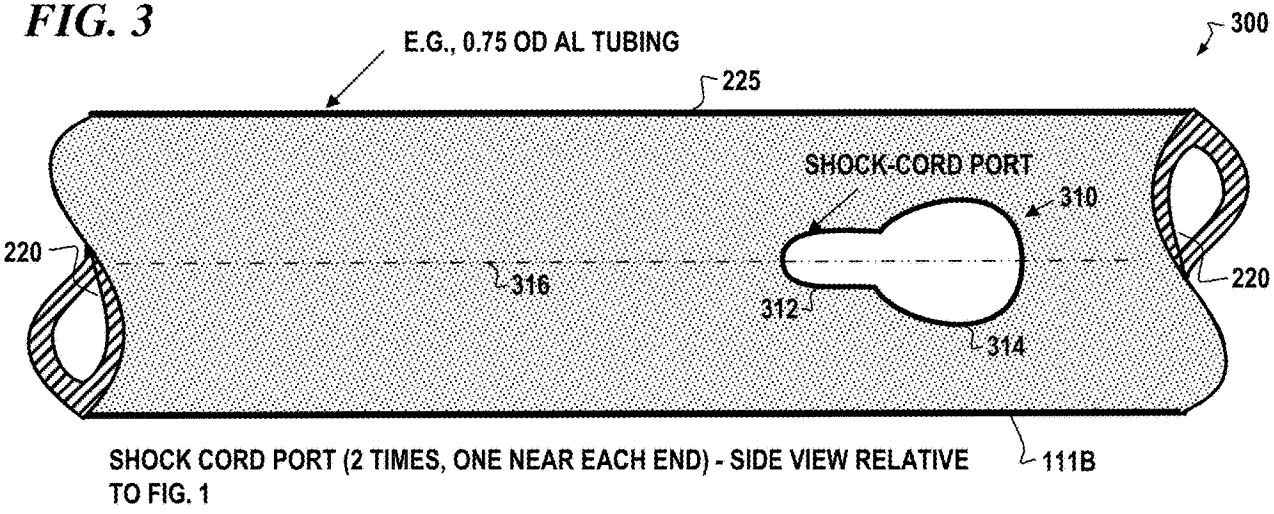
FIG. 3 is a detail illustration of a shock-cord port 310 in a segment 300 of a portable transfer board in accordance with certain exemplary embodiments of the present invention.

Turning now to FIG. 3, this figure illustrates detail of an exemplary shock-cord port 310 of a portable transfer board according to certain embodiments of the present invention. The shock-cord port 310 illustrated in FIG. 3 (which, in some embodiments, has a large-hole end 314 that allows passage of a knot or catch on the shock cord 140 for stretching or releasing tension in the shock cord 140, and a small-end hole 312 that allows the common diameter of the shock cord to fit in its notch, but holds the knot or small catch when shock cord 140 is in tension) is applicable to the portable transfer board embodiment that FIG. 1 illustrates (and that is illustrated in further detail in FIG. 2) and will be discussed in that context and with reference to FIG. 1 and FIG. 2.

The shock-cord ports 310 can be viewed as having a teardrop shape or as having a hole with an adjoining or contiguous slot or groove. Thus, each shock-cord port 310 comprises an opening with two sizes. As will be discussed in further detail below, in some embodiments, the shock cord 140 rests in the larger of the two opening regions during transportation of the portable transfer board and is caught in the smaller of the two opening regions when the portable transfer board is configured for transferring a person.

In one exemplary embodiment, the center of the larger area 314 of the shock-cord port 310 is substantially aligned with the central axis 316 of the tubing. The center, straight segment of tubing 110 has a longitudinal axis 316, about which that tubing is substantially rotationally symmetric. In some embodiments, the shock-cord port 310 is located in a position of the bend of the U-shaped tubing 111B so that the longitudinal axis projects substantially through the center of the larger open area 314 of the shock-cord port 310. The shock-cord port can be made using a milling machine, with a larger bit cutting the larger opening region 314 and a smaller bit cutting the slot 312.

Figure 4:
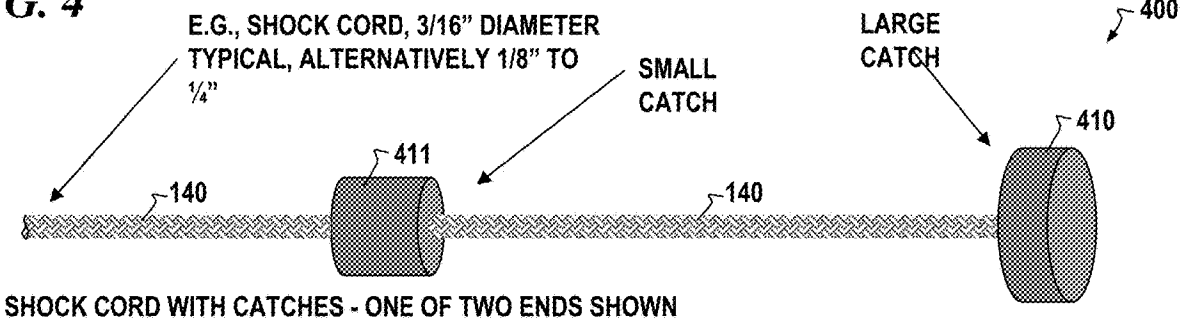
FIG. 4 is an illustration of a portion of a shock cord 400 of a portable transfer board that facilitates self assembly in accordance with certain exemplary embodiments of the present invention.
Figure 5A:
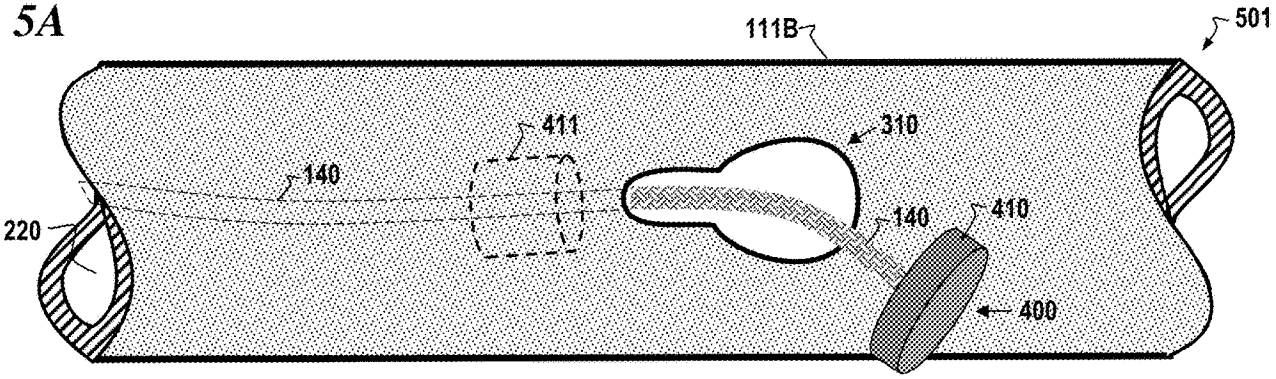
FIG. 5A is a detail illustration 501 of a shock-cord port 310 and an associated shock cord 400 of a portable transfer board in a state of disassembly or self-assembly in accordance with certain exemplary embodiments of the present invention.
Figure 5B:
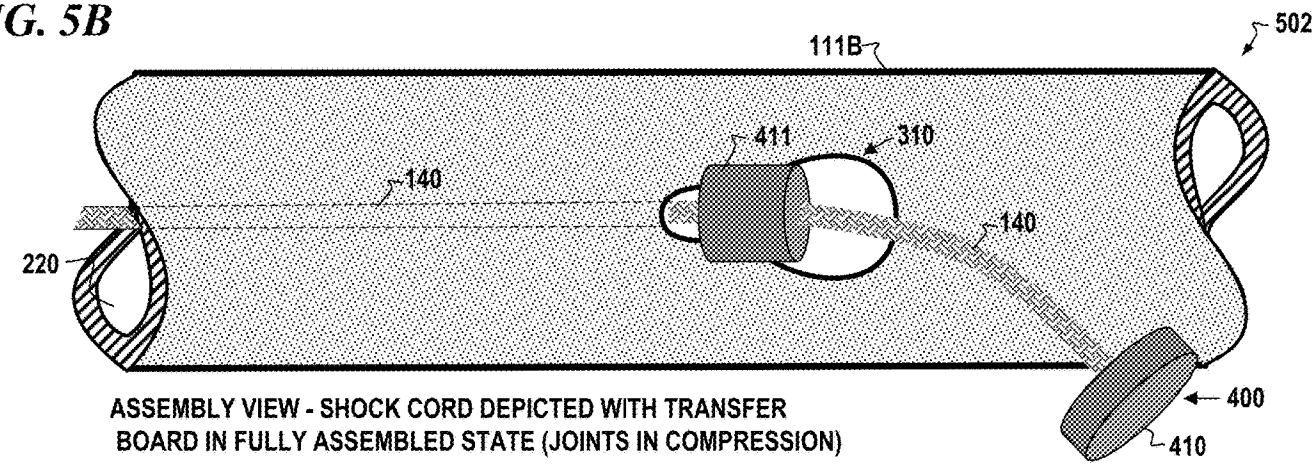
FIG. 5B is a detail illustration 502 of a shock-cord port 310 and an associated shock cord 400 of a portable transfer board in a fully assembled state for transferring a person in accordance with certain exemplary embodiments of the present invention.
Figure 5C:
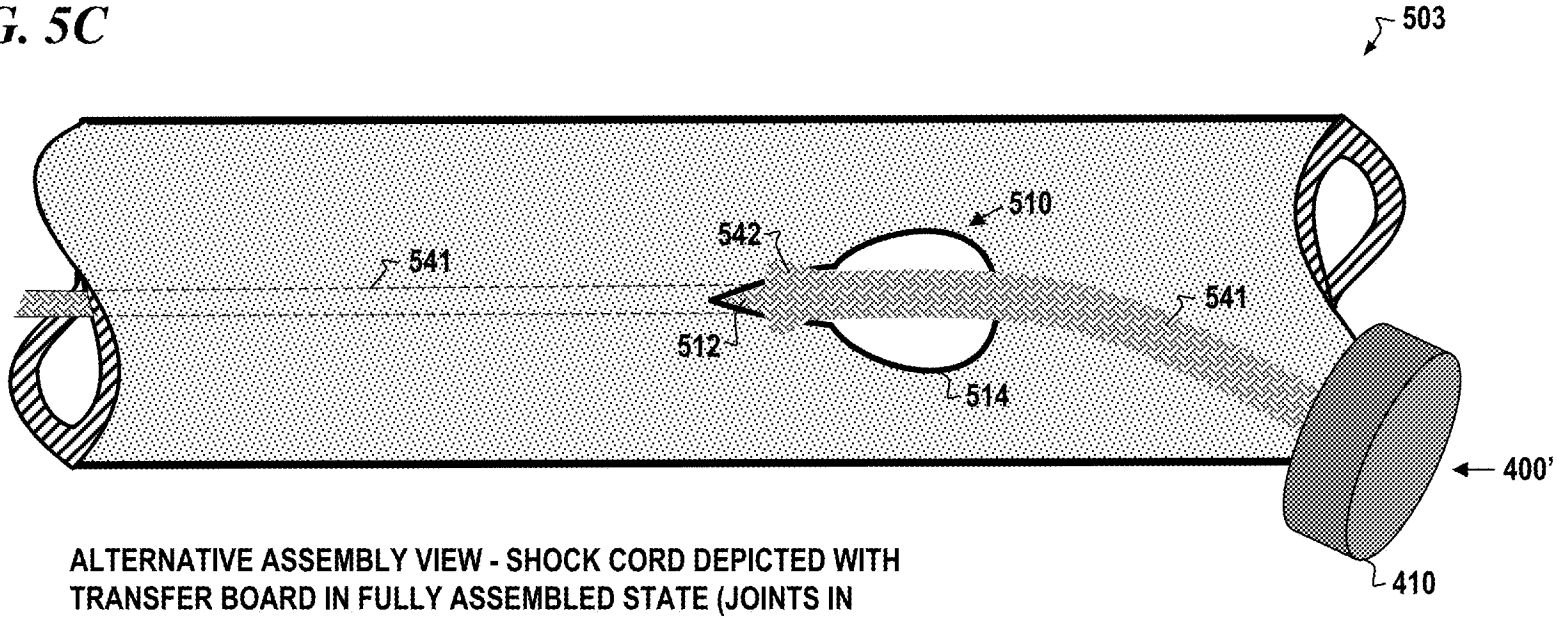
FIG. 5C is a detail illustration 503 of an alternative shock-cord port 510 and associated shock cord 400' of a portable transfer board in a fully assembled state for transferring a person in accordance with certain exemplary embodiments of the present invention.

Turning now to FIGS. 4, 5A, and 5B, FIG. 4 illustrates one end 400 of an exemplary shock cord 140 of a portable transfer board that facilitates self assembly according to certain embodiments of the present invention. In some embodiments, shock cord 140 includes a small catch 411 that is too large to fit through slot 312, but small enough to readily pass through the larger opening 314 of port 310 (some embodiments use a knot (such as a half hitch) in cord 140 in place of small catch 411). In some embodiments, shock cord 140 also includes a large catch 410 that is too large to fit through the larger opening 314, in order that the end always remains available for pulling by the user, and to make the end of shock cord 140 easier to grip by the user.

FIG. 5A illustrates detail of an exemplary shock-cord port 310 and an associated exemplary shock cord end 400 of a portable transfer board in a state of disassembly or self-assembly according to certain embodiments of the present invention. The small catch 411 is shown in dotted-line outline inside the tubing of end piece 111B, and the cord 140 is shown in the unstretched relaxed state. FIG. 5B illustrates detail of an exemplary shock-cord port 310 and an associated exemplary shock cord end 400 of a portable transfer board in a stretched fully assembled state for transferring a person according to certain embodiments of the present invention. The shock cord 140 and associated shock-cord port 310 illustrated in FIGS. 3, 4, 5A, and 5B are applicable to the portable transfer board embodiment that FIG. 1 illustrates (and that is illustrated in further detail in FIGS. 2 and 3) and will be discussed in that context and with reference to FIGS. 1, 2, and 3. The shock cord 140 and associated shock-cord port 310 illustrated in FIGS. 3, 4, 5A, and 5B are also applicable to some embodiments of all the other embodiments shown in the FIGS. 6-9E.

In the illustrated embodiment, the shock cord 140 comprises one or more filaments, yarns, threads, or similar elements that are elastic. In certain embodiments, the shock cord 140 comprises strips or filaments of natural or synthetic rubber with a sleeve or circumferential cover of woven material. In certain embodiments, the shock cord 140 can be a segment of a large rubber band. In certain embodiments, the shock cord 140 is an elastic strap. In certain embodiments, the shock cord 140 is a bungee cord. In certain embodiments, the shock cord 140 is a synthetic or natural rubber strap or cord. When stretched, the shock cord 140 applies tensile force against the stretch and typically returns to a relaxed state when released.

In a typical embodiment, the shock cord 140 has a 3/16-inch nominal diameter. Other embodiments may have diameters in a range of about 1/8 inch to 1/4 inch, with diameter optionally selected according to whether the portable transfer board is sized for a youth or for a large adult. Suitable shock-cord material is available online from industrial supply house McMaster-Carr of Aurora, Ohio.

In some embodiments, such as the illustrated embodiment of FIGS. 4, 5A, and 5B, the shock cord 140 includes four catches (e.g., in some embodiments, two large catches 410 and two small catches 411). (FIG. 4 illustrates one end 400 of the shock cord 140; the opposite end can be outfitted with a pair of like, commonly configured catches.) As compared to the small catch, the large catch 410 is located farther towards the distal end of shock-cord 140 than small catch 411 (or at the shock-cord end as illustrated).

In one exemplary embodiment, the large catch is a "ball-lock" fitting as available from McMaster-Carr for 3/16-inch-diameter shock cord. Such a fitting is ball-shaped, has a diameter of approximately 11/16 inches, and comprises a spring-loaded button. The shock cord extends through the fitting, including the button. More specifically, the shock cord runs through a hole in the body of the fitting and through a hole in the button of the fitting. Depressing the button releases lateral tension on the shock cord to facilitate moving the fitting lengthwise along the shock cord. When the button is not depressed, the hole in the fitting body and the hole in the button are slightly out of alignment so that the shock cord catches. Depressing the button aligns those two holes to facilitate moving the fitting along the shock cord. When the button is released, the ball-lock fitting clamps the shock cord so the ball-lock fitting maintains its longitudinal position on the shock cord. For further security, a knot can be tied in the shock cord between the ball-lock fitting and the shock-cord end. With the knot being larger in diameter than the hole in the fitting through which the shock cord extends, the ball-lock fitting is prevented from sliding past the knot. That is, the knot keeps the shock cord from slipping out of the ball-lock fitting. For such an embodiment, the large opening in the shock-cord port can have a diameter of approximately 3/8 inches, or in a range between 3/8 inches and 5/8 inches. With such dimensions, the 11/16 diameter of the ball-lock fitting is larger than the maximum dimension of the opening of the shock-cord port, and thus the shock-cord port catches the ball-lock fitting. See FIG. 5A.

In one embodiment, the large catch 410 is a bead or ball comprising a drilled hole through which the shock cord passes. If metal, the bead or ball can be permanently fixed to the shock cord by crimping an end or sides of the bead or ball. The bead or ball can alternatively be attached to the shock cord 140 using one or more pins or screws that pass laterally through the bead or ball and through the shock cord. In certain embodiments, such a bead or ball can be fused (e.g. using heat) or glued to the shock cord.

In some embodiments, the small catch 411 has a diameter that is larger than the width of the slotted opening 312 in the shock-cord port and that is smaller than the large opening 314 in the shock-cord port 310. Accordingly, the small catch 411 readily moves, feeds, or slides through the large opening of the shock-cord port (see FIG. 5A) but can be readily caught by and retained in the slot 312 as shown in FIG. 5B.

In certain exemplary embodiments, the small catch 411 is a smaller version of the large catch 410 as described above. In certain embodiments, the small catch 411 comprises a knot in the shock cord. For example, one or more knots (such as a half hitch or other suitable knot) can provide a localized increase in shock-cord diameter.

In the configuration shown in FIG. 5A (with the small catch 411 disposed inside the lumen 220 of the portable transfer board), the shock cord 140 applies a level of tension that is suitable for transportation, stowing, packing, or toting the portable transfer board. Further, this tension provides an assist for self assembly, so that the tubes self align for mating and assembly in connection with transitioning from a transportation configuration to a transfer configuration—that is, from a configuration suited for transporting the portable transfer board to a configuration suited for transferring a person.

For configuring the portable transfer board 100 into the transfer configuration, the transferee, caregiver, or other user grasps the large catch 410 and pulls. The pulling force stretches the shock cord 140, and the small catch 411 exits the shock-cord port 310 (to the outside of the tubing). The user then releases a fraction of the pulling force on the shock cord and maneuvers the small catch 411 into the groove 312. The groove 312 of the shock-cord port 310 catches the small catch 411 to maintain the shock cord 410 in the stretched state. The stretched shock cord forces the abutting tubes of the portable transfer board 100 to stay together as the transferee slides along the portable transfer board 100 when the board 100 is in the transfer configuration. Further, the compressive forces of the stretched shock cord can increase structural strength of the portable transfer board.

To transition the portable transfer board 100 back to the transportation state or configuration, the user can reverse the foregoing process and manually separate the tube segments of the portable transfer board.

Certain steps in the process described above, as well as in the other processes and methods disclosed or taught herein, may naturally need to precede others for the present invention to function as described. However, the present invention is not limited to the order of the steps described if such order or sequence does not adversely alter the functionality of the present invention to the extent of rendering the invention inoperable or nonsensical. That is, it is recognized that some steps may be performed before or after other steps or in parallel with other steps without departing from the scope and spirit of the present invention.

Turning now to FIG. 5C, this figure illustrates detail of an exemplary alternative shock-cord port 510 and associated exemplary shock cord end 400' of a portable transfer board in a fully assembled state (i.e., with tensile force on shock cord 140) for transferring a person according to certain embodiments of the present invention. When wedged into slot 512, in some embodiments a bulge 542 forms just outside the slot, further assisting in holding shock cord 140 in place. In the embodiment that FIG. 5C illustrates, the shock cord 140 binds or catches in the tapered (e.g., V-shaped) groove 512 of the shock-cord port 510 without aid of a small catch (small catch 411 is omitted). Accordingly, certain embodiments of the portable transfer board can function without a small catch 411.

Figures 6A, 6B:
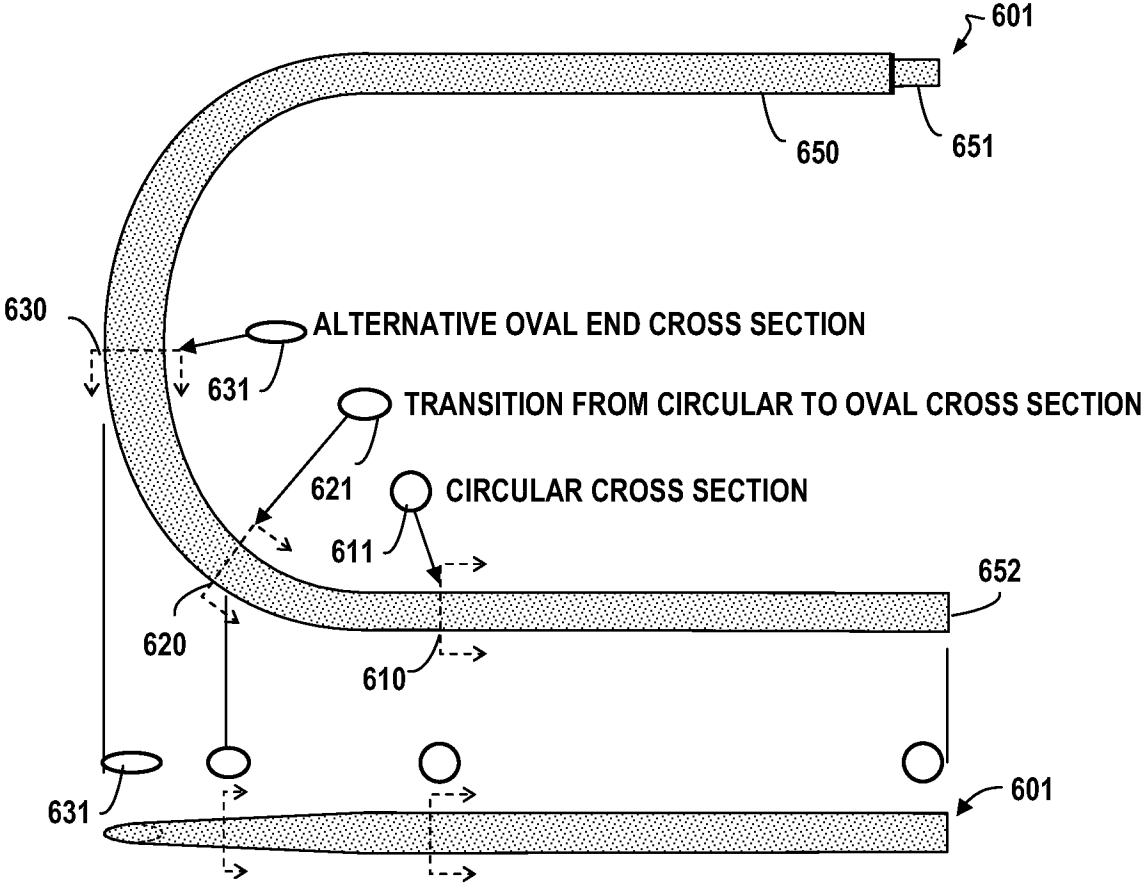
FIG. 6A is a plan-view illustration of a portable transfer board 601 representing an alternative form, in which a thinner lead-in end facilitates moving a person onto or off of the portable transfer board 601 in accordance with certain exemplary embodiments of the present invention.
FIG. 6B is a side-view illustration of portable transfer board 601 representing an alternative form, in which a thinner lead-in end facilitates moving a person onto or off of portable transfer board 601 in accordance with certain exemplary embodiments of the present invention.

Turning now to FIG. 6A, this figure illustrates a plan-view of an exemplary portable transfer board end piece 601 (which can be used in place of end pieces 111A and/or 111B of FIG. 1) having alternative form in which a thinner lead-in end facilitates moving a person onto or off of the portable transfer board according to certain embodiments of the present invention. In the embodiment that FIG. 6A illustrates, the ends of the portable transfer board are tapered (thinner at the end (in some embodiments, at dashed line 630, the cross section is a relatively thin oval 631) and thicker (e.g., having a circular cross section 611 at dashed line 610) toward the ends 651 and 652, with a gradual tapered transition (e.g., thicker oval cross section 621 at dashed line 620) in between) to facilitate getting the transferee onto the portable transfer board. The taper can further help extract the portable transfer board from under the transferee, once transfer is complete. That is, the taper can help pull the portable transfer board out from under a person who has been successfully transferred.

FIG. 6B is a side view of end piece 601. In some embodiments, such a flattened end shown in this side view is applied to some versions of any of the embodiments illustrated in FIGS. 8A-9E. (The tubing can be squashed or flattened around the bend, to provide a lead-in for scooting onto the transfer board and for pulling the transfer board out from under the person being transferred. In other words, the end pieces (e.g., with U-shaped segments) can have a tapered cross section at the ends.)

The taper can be formed by compressing the tubing near the end of the portable transfer board (e.g. applying force from top to bottom). In one embodiment, the radiused section of tubing is hydraulically pressed from a circular cross section 611 into an oval cross section 631 with a taper in between using a die having the desired cross section. Alternatively, stock tubing of a desired profile (for example oval or substantially triangular with rounded corners) can be custom fabricated by a tubing mill. A segment of such thinner and wider tubing can be welded to cylindrical tubing, for example. Accordingly, the portable transfer board 100 can comprise tubing of differing cross-sectional profiles.

Turning now to FIG. 7A-7D, this 4-part figure illustrates another exemplary portable transfer board 701 in progressive states of assembly according to certain embodiments of the present invention. The illustrated embodiment incorporates twelve tubing segments of ¾-inch-diameter (about 19 mm) commercial tent-pole tubing with ferrules 214 and shock cord 740, all as available from Quest Outfitters of Sarasota, Fla.

In some embodiments, four of the tubing ends 715 having ferrules 214 extending therefrom are attached to a first end piece 714 by drilling four holes, each approximately ¾ inch (about 19 mm) in diameter, partially into the end piece 714 and fixing the four tubing end segments 715 in the holes via epoxy or welding. In some embodiments, four of the tubing ends 717 (having hollow ends for receiving ferrules 214 of the center tubing pieces 710) are attached to a first end piece 716 by drilling four holes, each approximately ¾ inch (about 19 mm) in diameter, partially into the end piece 714 and fixing the four tubing end segments 715 in the holes via epoxy or welding. Shock cord 740 extends through smaller holes that extend through in the end piece 714, with a knot or hardware on the shock cord preventing the shock-cord end from slipping back through each smaller hole. In some embodiments, each one of the shock cords 740 is of the same material as shock cord 140, but is implemented as a plurality of separate pieces rather than as the single piece used for shock cord 140. The second, opposite-end piece 716 is prepared in a like fashion. The end pieces 714 and 716 can be made of a plastic material, such as nylon or polyamide; of a hard wood, such as maple or oak; or of a lightweight metal, such as aluminum. In some embodiments, the cross sectional shape of end pieces 714 and 716 is rectangular (as shown here), or circular or oval (as shown in FIG. 7E), or other suitable shape. In some embodiments, the end pieces 714 and 716 are tapered from a thin cross section at the distal end to a thicker cross section toward the tubing pieces 715 and 717.

As illustrated, the end pieces 714 and 716 are thicker than the tubing 715 and 717. However, in certain other embodiments benefit can be obtained by fabricating the end pieces to provide a thickness that is substantially equal to the tubing diameter. In certain embodiments, the end pieces can be slightly thinner than the tubing or slightly thicker. In certain embodiments, the tubing can protrude laterally from thinned end pieces. In certain embodiments, the end pieces can be tapered down, away from the tubing to facilitate a transferee scooting onto the portable transfer board or pulling the portable transfer board out from under the transferee.

FIG. 7A illustrates the portable transfer board 701 in a disassembled configuration, whereby the three sections can be readily folded for convenient toting. In this configuration, the shock cords, which extend through each of the four sets of three tubes, provide some tension on the sections to facilitate assembly.

FIG. 7B illustrates the portable transfer board 701 in a partially assembled state whereby the shock cords have begun aligning and assembling the sets of tubing.

FIG. 7C illustrates the portable transfer board 701 in a further stage of self assembly, whereby all of the tubing segments are aligned and partially mated.

FIG. 7D illustrates the portable transfer board 701 fully assembled, whereby the shock cords have pulled the tubing segments 717, 710 and 715 together. In the illustrated configuration, the portable transfer board 710 is set for transferring a person.

After the person is transferred, the user (for example, the person or a caregiver) can return the portable transfer board to the transportation configuration by manually pulling the joints apart. That is, the user can overcome the shock-cord tension to disassemble the portable transfer board, returning it to the state illustrated in FIG. 7A for stowing in a backpack or other place, ready for toting and subsequent usage.

FIG. 7E is a perspective (substantially plan-view) illustration of another portable transfer board 705 in a final progressive state of assembly in accordance with certain exemplary embodiments of the present invention.

FIG. 8A is a plan-view illustration of another portable transfer board 801 in a first progressive state of assembly in accordance (disassembled for collapse into a transport configuration), according to embodiments of the present invention. In this embodiment, portable transfer board 801 includes two U-shaped end pieces 811A and 811B that connect directly to one another. Some such embodiments include a shock cord 140 internal to the lumens of the tubing, which include ports 310 as shown in FIGS. 1-3 as described and set forth above. In some embodiments, no shock cord 140 is used, and the pieces 811A and 811B are simply stacked on one another for transport.

FIG. 8B is a plan-view illustration of another portable transfer board 802 in a first progressive state of assembly in accordance (disassembled for collapse into a transport configuration), according to embodiments of the present invention. In this embodiment, portable transfer board 802 includes two U-shaped end pieces 811A and 811B that each connect to one intermediate piece 810 on each side rather than directly to one another. Some such embodiments include a shock cord 140 internal to the lumens of the tubing, which include ports 310 as shown in FIGS. 1-3 as described and set forth above. In some embodiments, no shock cord 140 is used, and the pieces 811A, 810, and 811B are simply stacked on one another for transport.

FIG. 8C is a plan-view illustration of another portable transfer board 803 in a first progressive state of assembly in accordance (disassembled for collapse into a transport configuration), according to embodiments of the present invention. In this embodiment, portable transfer board 803 includes two U-shaped end pieces 811A and 811B that each connect to a plurality of intermediate piece 810 on each side rather than directly to one another. Some such embodiments include a shock cord 140 internal to the lumens of the tubing, which include ports 310 as shown in FIGS. 1-3 as described and set forth above. In some embodiments, no shock cord 140 is used, and the pieces 811A, 810, and 811B are simply stacked on one another for transport.

FIG. 8D is a plan-view illustration of another portable transfer board 804 in a first progressive state of assembly in accordance (disassembled for collapse into a transport configuration), according to embodiments of the present invention. In this embodiment, portable transfer board 804 includes two U-shaped end pieces 811A and 811B that each connect to an H-shaped intermediate piece 822 (which includes two side segments 820 and a cross-over center segment 821), rather than directly to one another. In some embodiments, the center segment 821 is bent or shaped to extend below the overall plane of the rest of transfer board 804 as illustrated in FIG. 8E. Some such embodiments include a shock cord 140 internal to the lumens of the tubing, which include ports 310 as shown in FIGS. 1-3 as described and set forth above. In some embodiments, no shock cord 140 is used, and the pieces 811A, 810, and 811B are simply stacked on one another for transport.

FIG. 8E is an end-view illustration of portable transfer board 804 in a second progressive state of assembly in accordance (assembled for use in a transfer configuration), according to embodiments of the present invention, showing the center segment 821 is bent or shaped to extend below the overall plane of the rest of transfer board 804. This allows the transferee to scoot across the length of the portable transfer board 804 without hitting center segment 821. In some embodiments, center segment 821 provides additional strength and stiffness, and facilitates storage. In some embodiments, no shock cord 140 is used, and the pieces 811A, 822, and 811B are simply stacked on one another for transport.

FIG. 8F is a plan-view illustration of another portable transfer board 806 in a first progressive state of assembly in accordance (disassembled for collapse into a transport configuration), according to embodiments of the present invention. In this embodiment, portable transfer board 804 includes two U-shaped end pieces 811A and 811B that each connect to an H-shaped intermediate piece 832 (which includes two side segments 820 and a plurality of cross-over center segments 831), rather than directly to one another. In some embodiments, each center segment 831 is bent or shaped to extend below the overall plane of the rest of transfer board 806 as illustrated in FIG. 8E. Some such embodiments include a shock cord 140 internal to the lumens of the tubing, which include ports 310 as shown in FIGS. 1-3 as described and set forth above. In some embodiments, no shock cord 140 is used, and the pieces 811A, 810, and 811B are simply stacked on one another for transport.

FIG. 9A is a plan-view illustration of another portable transfer board 901 in a first progressive state of assembly in accordance (disassembled for collapse into a transport configuration), according to embodiments of the present invention. In this embodiment, portable transfer board 901 includes two generally U-shaped end pieces 911A and 911B (wherein the parallel side segments are connected to one another by a plurality (in this case, two) of straight segments at 45-degree angles to the parallel segments) that connect directly to one another or through one or more intermediate pieces 810, 822, and/or 832 as described above in FIGS. 8A-8F. Some such embodiments include a shock cord 140 internal to the lumens of the tubing, which include ports 310 as shown in FIGS. 1-3 as described and set forth above. In some embodiments, no shock cord 140 is used, and the pieces 911A and 911B are simply stacked on one another for transport.

FIG. 9B is a plan-view illustration of another portable transfer board 902 in a first progressive state of assembly in accordance (disassembled for collapse into a transport configuration), according to embodiments of the present invention. In this embodiment, portable transfer board 902 includes two generally U-shaped end pieces 921A and 921B (wherein the parallel side segments of end pieces 921A and 921B are connected to one another by a plurality (in this case, two) of straight segments at 60-degree (or other suitable) angles to the parallel segments). In some embodiments, end pieces 931A and 931B connect directly to one another or through one or more intermediate pieces 810, 822, and/or 832 as described above in FIGS. 8A-8F. Some such embodiments include a shock cord 140 internal to the lumens of the tubing, which include ports 310 as shown in FIGS. 1-3 as described and set forth above. In some embodiments, no shock cord 140 is used, and the pieces 911A and 911B are simply stacked on one another for transport.

FIG. 9C is a plan-view illustration of another portable transfer board 903 in a first progressive state of assembly in accordance (disassembled for collapse into a transport configuration), according to embodiments of the present invention. In this embodiment, portable transfer board 903 includes two end pieces 931A and 931B (wherein the parallel side segments of end pieces 931A and 931B are connected to one another by a plurality (in this case, five) of straight segments at 22.5-degree (or other suitable) angles to one another and to the parallel segments). In some embodiments, end pieces 931A and 931B connect directly to one another or through one or more intermediate pieces 810, 822, and/or 832 as described above in FIGS. 8A-8F. Some such embodiments include a shock cord 140 internal to the lumens of the tubing, which include ports 310 as shown in FIGS. 1-3 as described and set forth above. In some embodiments, no shock cord 140 is used, and the pieces 911A and 911B are simply stacked on one another for transport.

FIG. 9D is a plan-view illustration of another portable transfer board 904 in a first progressive state of assembly in accordance (disassembled for collapse into a transport configuration), according to embodiments of the present invention. In this embodiment, portable transfer board 904 includes two end pieces 941A and 941B (wherein the parallel side segments of end pieces 941A and 941B are connected to one another by a single straight segment at 90-degree (or other suitable different) angles to the parallel segments). In some embodiments, end pieces 941A and 941B connect directly to one another or through one or more intermediate pieces 810, 822, and/or 832 as described above in FIGS. 8A-8F. Some such embodiments include a shock cord 140 internal to the lumens of the tubing, which include ports 310 as shown in FIGS. 1-3 as described and set forth above. In some embodiments, no shock cord 140 is used, and the pieces 911A and 911B are simply stacked on one another for transport.

FIG. 9E is a plan-view illustration of another portable transfer board 905 in a first progressive state of assembly in accordance (disassembled for collapse into a transport configuration), according to embodiments of the present invention. In this embodiment, portable transfer board 905 includes two end pieces 951A and 951B (wherein the parallel side segments of end pieces 951A and 951B are connected to one another by a single straight segment at 90-degree (or other suitable different) angles to the parallel segments, with a curved (e.g., quarter-circle) transition). In some embodiments, end pieces 951A and 951B connect directly to one another or through one or more intermediate pieces 810, 822, and/or 832 as described above in FIGS. 8A-8F. Some such embodiments include a shock cord 140 internal to the lumens of the tubing, which include ports 310 as shown in FIGS. 1-3 as described and set forth above. In some embodiments, no shock cord 140 is used, and the pieces 911A and 911B are simply stacked on one another for transport.

In accordance with the present disclosure, in certain embodiments, a system, for transferring a person having limited mobility, comprises: first and second U-shaped members providing respective ends of a portable transfer board; and a plurality of straight members that mate with the first and second U-shaped members to configure the portable transfer board for transfer and that substantially decouple for transportation of the portable transfer board. In certain embodiments of such a system, the straight members comprise a pair of tubes. In certain embodiments of such a system, each of the U-shaped members comprises a respective bent tube. In certain embodiments of such a system, an elastic cord extends at least partially through at least two of the first and second U-shaped members and the plurality of straight members. In certain embodiments of such a system, at least one joint of the portable transfer board telescopes. In certain embodiments of such a system, at least one of the plurality of straight members comprises a ferrule. In certain embodiments of such a system, at least one of the first and second U-shaped members comprises a ferrule. In certain embodiments of such a system, each of the plurality of straight members comprises a plurality of tubes that mate with one another to configure the portable transfer board for transferring the person.

In accordance with the present disclosure, in certain embodiments, a transfer board is stowable inside a package having a maximum dimension that is substantially smaller than a length of the transfer board when the transfer board is configured for transferring a person. In certain embodiments of such a transfer board, the length is at least about twenty-four inches, and the maximum dimension is less than about fifteen inches. In certain embodiments of such a transfer board, the maximum dimension is less than about one-half the length. In some embodiments, the transfer board rearranges into a backpack-sized package for carrying by a person who is in a wheelchair. In certain embodiments of such a transfer board, the maximum dimension is less than about thirteen inches. In certain embodiments of such a transfer board, the length is at least about thirty inches. Certain embodiments of such a transfer board, comprise a joint that is in compression when the transfer board is configured for transferring the person. In certain embodiments, the transfer board is in compression when configured for transferring the person.

In accordance with the present disclosure, in certain embodiments a portable transfer board has at least two configurations, the first at least about two times longer than the second. In certain embodiments, the portable transfer board is sized for carrying in a backpack of a wheelchair-bound person in the compact one of the two configurations. In certain embodiments of such a portable transfer board, the first configuration has a length of less than about fifteen inches and the second configuration has a length of at least about twenty-eight inches (about 71.1 cm). In certain embodiments of such a portable transfer board, the first configuration has dimensions suitable for toting by a wheelchair-bound adult having an ability to configure the portable transfer board between the at least two configurations, and the second configuration has dimensions suitable for transferring the wheelchair-bound adult into or out of a wheelchair.

In accordance with the present disclosure, in certain embodiments, a portable transfer board includes: a first transfer-board end member and a second transfer-board end member that detachably attaches to the first member end for configuring the portable transfer board for transferring a person. In certain embodiments, the portable transfer board further comprises a third member that detachably attaches between the first end member and the second end member for configuring the portable transfer board for transferring the person.

In accordance with the present disclosure, in certain embodiments, a portable transfer board comprises: a first transfer board end; a second transfer board end; and a first segment that detachably attaches to the first end and to the second end for configuring the portable transfer board for transferring a person. In certain embodiments, the portable transfer board further comprises a second segment that detachably attaches to and between the first end and to the first segment for configuring the portable transfer board for transferring the person.

In accordance with the present disclosure, in certain embodiments, a portable transfer board comprises: a first transfer board end; a second transfer board end; and a member that detachably attaches to the first member and to the second member for configuring the portable transfer board for transferring a person. In certain embodiments, the portable transfer board further comprises a second member that detachably attaches to the first member and to the second member for configuring the portable transfer board for transferring the person. In certain embodiments of such a portable transfer board, the member attaches to the first and second transfer-board ends to configure the portable transfer board for transferring the person, and the member detaches from the first and second transfer-board ends to configure the portable transfer board for stowage. In certain embodiments of such a portable transfer board, the first transfer-board end, the second transfer-board end, and the member are operative to self assemble. In certain embodiments of such a portable transfer board, a shock cord connects the first transfer-board end to the member to facilitate assembly of the portable transfer board.

In accordance with the present disclosure, in certain embodiments, a portable transfer board comprises: a loop of tubing segments sized for transferring a wheelchair-bound person; and at least two joints for connecting and disconnecting the tubing segments. In certain embodiments, the portable transfer board further comprises a shock cord extending through at least two of the tubing segments.

In accordance with the present disclosure, in certain embodiments, a method comprises: providing a telescoping member; positioning the telescoping member between a wheelchair and a seat; and moving a person between the wheelchair and the seat while supported by the telescoping member.

In accordance with the present disclosure, in certain embodiments, a portable transfer board comprises a telescoping member.

Some embodiments use a powdercoat covering on the portable transfer board that includes Teflon® for ease of sliding the transferee across the portable transfer board.

Some embodiments use anti-skid ends and/or hook ends on the portable transfer board to hold the invention to the source and destination of the transfer during sliding the transferee across the portable transfer board.

Some embodiments use any of the embodiments of the invention set forth above also as a collapsible cane, wherein at least one end includes a non-skid or non-slippery outer edge for contact with the ground.

Other versions of any of the embodiments of the invention set forth above, instead of nipple ends and socket ends as set forth above, use hinges or other means for allowing disassembly or folding into the transportable configuration.

In some embodiments, the present invention provides a system for transferring a person having limited mobility. This system includes first and second U-shaped end members providing respective ends of a portable transfer board; and a plurality of intermediate (e.g., in some embodiments, straight) members that mate with the first and second U-shaped end members to configure the portable transfer board for transfer and that substantially decouple for transportation of the portable transfer board. In some embodiments, the intermediate members include a pair of tubes. In some embodiments, each of the U-shaped members includes a respective bent tube connecting segment connected to two parallel side segments. In some embodiments, the respective connecting segment is semicircular in shape. In some embodiments, the respective connecting segment is half-ellipse in shape. In some embodiments, the respective connecting segment is polygonal in shape. In some embodiments, an elastic cord extends at least partially through at least two of the first and second end members and the plurality of intermediate members. In some embodiments, at least one joint of the portable transfer board telescopes. In some embodiments, at least one of the plurality of intermediate members includes a ferrule. In some embodiments, at least one of the first and second U-shaped members include a ferrule. In some embodiments, each of the plurality of straight members comprises a plurality of tubes that mate with one another to configure the portable transfer board for transferring the person.

In some embodiments, the present invention provides a transfer board that is stowable inside a package having a maximum dimension that is substantially smaller than a length of the transfer board when the transfer board is configured for transferring a person. In some embodiments, the package size is about half the length of the transfer board when the transfer board is configured for transferring a person. In some embodiments, the package size is about one third the length of the transfer board when the transfer board is configured for transferring a person. In some embodiments, the package size is less than 40% of the length of the transfer board when the transfer board is configured for transferring a person. In some embodiments, the package size is less than 50% of the length of the transfer board when the transfer board is configured for transferring a person. In some embodiments, the length is at least about twenty-four inches (61 cm), and wherein the maximum dimension of the package is less than about fifteen inches (38.1 cm). In some embodiments, the maximum dimension is less than about one half the length. In some embodiments, the package comprises a backpack sized for carrying by an adult in a wheelchair. In some embodiments, the maximum dimension is less than about thirteen inches (30 cm). In some embodiments, the length is at least about thirty inches (76 cm). Some embodiments further include a joint that is in compression when the transfer board is configured for transferring the person. In some embodiments, the transfer board is in compression when configured for transferring the person.

In some embodiments, the present invention provides a portable transfer board having at least two configurations, the first at least about two times longer than the second. In some such embodiments, the portable transfer board is sized for carrying in a backpack of a wheelchair bound person in one of the two configurations. In some embodiments, the first configuration has a length of less than about fifteen inches (38 cm) and the second configuration has a length of at least about twenty-eight inches (71 cm). In some such embodiments, the first configuration has dimensions suitable for toting by a wheelchair bound adult having an ability to configure the portable transfer board between the at least two configurations, and the second configuration has dimensions suitable for transferring the wheelchair bound adult into or out of a wheelchair.

In some embodiments, the present invention provides a portable transfer board that includes a first transfer board end; a second transfer board end; and a member that detachably attaches to the first transfer board end and to the second transfer board end for configuring the portable transfer board for transferring a person. Some embodiments further include a second member that detachably attaches to the first member and to the second member for configuring the portable transfer board for transferring the person. In some embodiments, the member attaches to the first and second transfer board ends to configure the portable transfer board for transferring the person, and the member detaches from the first and second transfer board ends to configure the portable transfer board for stowage. In some embodiments, the first transfer board end, the second transfer board end, and the member are operative to self assemble. In some embodiments, a shock cord connects the first transfer board end to the member to facilitate assembly of the portable transfer board.

In some embodiments, the present invention provides a portable transfer board that includes a loop of tubing segments sized for transferring a wheelchair bound person; and at least two joints for connecting and disconnecting the tubing segments. Some embodiments further include a shock cord extending through at least two of the tubing segments. In some embodiments, the present invention provides a method that includes providing a telescoping member; positioning the telescoping member between a wheelchair and a seat; and moving a person between the wheelchair and the seat while supported by the telescoping member. In some embodiments, the present invention provides a portable transfer board comprising a telescoping member.

In some embodiments, the present invention provides an apparatus that includes a plurality of end pieces including a first end piece and a second end piece, wherein each end piece includes: a plurality of parallel segments including a first parallel segment and a second parallel segment, and a connecting segment, wherein the first parallel segment of the first end piece is configured to be connected to the second parallel segment of the first end piece by the connecting segment of the first end piece; and wherein the first end piece and the second end piece are configured to be assembled into a disassemble-able unitary transfer module. In some embodiments, the connecting segment is semicircular in shape. In some embodiments, the connecting segment is polygonal in shape. Some embodiment further include a cord, wherein the cord is configured to follow a path through an interior of each of the plurality of end pieces, and wherein the cord is configured to provide a tightening mechanism that holds the unitary transfer module together when assembled. In some embodiments, the first end piece includes a keyhole configured to provide a location on the first end piece where the cord exits the interior of the first end piece such that the cord can be accessed by a user of the unitary transfer module in order to tighten the plurality of end pieces together to form the assembled unitary transfer module.

Some embodiment further include a plurality of intermediate connection portions including a first intermediate connection portion and a second intermediate connection portion, wherein the first parallel segment of the first end piece and first parallel segment of the second end piece are configured to be connected to each other via the first intermediate connection portion.

In some embodiments, the connecting segment includes a single continuous bend radius.

In some embodiments, the connecting segment includes a first curved corner and a second curved corner.

In some embodiments, the first curved corner has a first bend radius, wherein the second curved corner has a second bend radius, and wherein the first bend radius is equivalent to the second bend radius.

Some embodiment further include a plurality of intermediate connection portions including a first intermediate connection portion and a second intermediate connection portion, wherein the first parallel segment of the first end piece and first parallel segment of the second end piece are configured to be connected to each other via the first intermediate connection portion; and a cord, wherein the cord is configured to follow a path through an interior of each of the plurality of end pieces and through each of the plurality of intermediate connection portions, and wherein the cord is configured to provide a tightening mechanism that holds the unitary transfer module together when assembled.

Some embodiment further include a plurality of intermediate connection portions including a first intermediate connection portion, a second intermediate connection portion, a third intermediate connection portion, and a fourth intermediate connection portion, wherein a second end of the first intermediate connection portion is configured to connect to a first end of the third intermediate connection portion, wherein the first parallel segment of the first end piece is configured to connect to a first end of the first intermediate portion, and wherein the first parallel segment of the second end piece is configured to connect to a second end of the third intermediate connection portion.

Some embodiment further include a first intermediate connection portion; a second intermediate connection portion; and a cross support, wherein the first and second intermediate connection portions are parallel with each other, wherein the first intermediate connection portion is connected to the second intermediate connection portion by the cross support, and wherein the cross support runs perpendicular between the first and second intermediate connection portions.

Some embodiment further include the unitary transfer module has a plane that parallels a path from the first end piece to the second end piece when the unitary transfer module is assembled, and wherein the cross support includes a curvature that curves below the plane of the unitary transfer module.

Some embodiment further include the cross support includes a curvature.

Some embodiment further include a first intermediate connection portion; a second intermediate connection portion; and a cross support, wherein the first and second intermediate connection portions are parallel with each other, wherein the first intermediate connection portion is connected to the second intermediate connection portion by the cross support, wherein the cross support runs perpendicular between the first and second intermediate connection portions, wherein the first parallel segment of the first end piece is configured to connect to a first end of the first intermediate portion, and wherein the first parallel segment of the second end piece is configured to connect to a second end of the first intermediate connection portion.

Some embodiment further include a first intermediate connection portion; a second intermediate connection portion; a first cross support; and a second cross support, wherein the first and second intermediate connection portions are parallel with each other, wherein the first intermediate connection portion is connected to the second intermediate connection portion by the first cross support and the second cross support, and wherein the first and second cross supports are parallel with each other and run perpendicular between the first and second intermediate connection portions.

Some embodiment further include a first intermediate connection portion; a second intermediate connection portion; a first cross support; and a second cross support, wherein the first and second intermediate connection portions are parallel with each other, wherein the first intermediate connection portion is connected to the second intermediate connection portion by the first cross support and the second cross support, wherein the first and second cross supports are parallel with each other and run perpendicular between the first and second intermediate connection portions, wherein the first parallel segment of the first end piece is configured to connect to a first end of the first intermediate portion, and wherein the first parallel segment of the second end piece is configured to connect to a second end of the first intermediate connection portion.

In some embodiments, the connecting segment includes two sides that are adjoined to each other at a ninety-degree angle.

In some embodiments, the connecting segment includes two sides that are adjoined to each other at a sixty-degree angle.

In some embodiments, the connecting segment includes five sides.

In some embodiments, the connecting segment includes a single side that runs perpendicular between the first parallel segment and the second parallel segment.

Technology for portably transferring someone having limited mobility has been described. From the description, it will be appreciated that an embodiment of the present invention overcomes limitations of the prior art. Those skilled in the art will appreciate that the present invention is not limited to any specifically discussed application or implementation and that the embodiments described herein are illustrative and not restrictive. Furthermore, the particular features, structures or characteristics that are disclosed may be combined in any suitable manner in one or more embodiments based on this disclosure and ordinary skill. Those of ordinary skill having benefit of this disclosure can make, use, and practice a wide range of embodiments via combining the disclosed features and elements in many permutations without undue experimentation. This disclosure not only includes the illustrated and described embodiments, but also provides a rich and detailed roadmap for creating many additional embodiments using the various disclosed technologies, elements, features, and their equivalents. From the description of the exemplary embodiments, equivalents of the elements shown herein will suggest themselves to those skilled in the art, and ways of constructing other embodiments of the present invention will appear to practitioners of the art. Therefore, the scope of the present invention is to be limited only by the accompanying claims.

What is claimed is:

1. A portable transfer board for transferring a person between a first surface and a second surface, comprising:

a first portable transfer board end section comprising a first straight tubing segment, a second straight tubing segment that extends parallel to the first straight tubing segment, and a first U-shaped segment that extends and transitions between distal ends of the first straight tubing segment and the second straight tubing segment in the portable transfer board;

a second portable transfer board end section comprising a third straight tubing segment, a fourth straight tubing segment that extends parallel to the third straight tubing segment, a second U-shaped segment that extends and transitions between distal ends of the third straight tubing segment and the fourth straight tubing segment in the portable transfer board, and a narrowed ferrule tube that extends beyond a joint end of at least one of the third straight tubing segment and the fourth straight tubing segment; and a shock cord that extends through the narrowed ferrule, at least a portion of the first portable transfer board end section, and at least a portion of the second portable transfer board end section to facilitate a substantially flush, rigid alignment between joint ends of the first and second portable transfer board end sections over the narrowed ferrule in an assembled configuration of the portable transfer board, wherein:

in the assembled configuration of the portable transfer board, the first straight tubing segment and the third straight tubing segment extend parallel to the second straight tubing segment and the fourth straight tubing segment at a separation distance of about six inches apart with open space between the first, second, third, and fourth straight tubing segments.

2. The portable transfer board according to claim 1, wherein the first U-shaped segment and the second U-shaped segment are formed having a single continuous bend radius.

3. The portable transfer board according to claim 1, wherein:

the first U-shaped segment and the second U-shaped segment are formed having a single continuous bend radius;

the first U-shaped segment is formed having a gradual tapered transition from an oval tubular cross section at a first longitudinal end of the portable transfer board to a substantially circular cross section at the distal ends of the first straight tubing segment and the second straight tubing segment along the single continuous bend radius; and the second U-shaped segment is formed having the gradual tapered transition from the oval tubular cross section at a second longitudinal end of the portable transfer board to the substantially circular cross section at the distal ends of the third straight tubing segment and the fourth straight tubing segment along the single continuous bend radius.

4. The portable transfer board according to claim 1, wherein:

at least one of the first portable transfer board end section and the second portable transfer board end section comprises a shock cord port, the shock cord port comprising a larger opening and a smaller slot;

the shock cord comprises a large catch positioned on the shock cord proximate to a distal end of the shock cord and a small catch positioned along the shock cord at a distance from the distal end of the shock cord;

the small catch is sized small enough to pass through the large opening but too large to fit through smaller slot; and the large catch is sized too large to fit through either the smaller slot or the larger opening.

5. The portable transfer board according to claim 1, wherein in the assembled configuration of the portable transfer board, the first portable transfer board end section and the second portable transfer board end section are in a single plane and have flush joints.

6. The portable transfer board according to claim 1, wherein in the assembled configuration of the portable transfer board, the portable transfer board has a greater length than width, and the length is about two to four feet.

7. A portable transfer board for transferring a person between a first surface and a second surface, comprising:

a first portable transfer board end section comprising a first straight tubing segment, a second straight tubing segment that extends parallel to the first straight tubing segment, and a first U-shaped segment having a single continuous bend radius that extends between distal ends of the first straight tubing segment and the second straight tubing segment in the portable transfer board;

a second portable transfer board end section comprising a third straight tubing segment, a fourth straight tubing segment that extends parallel to the third straight tubing segment, a second U-shaped segment having the single continuous bend radius that extends between distal ends of the third straight tubing segment and the fourth straight tubing segment in the portable transfer board, and a narrowed ferrule tube that extends beyond a joint end of at least one of the third straight tubing segment and the fourth straight tubing segment; and a shock cord that extends through the narrowed ferrule, at least a portion of the first portable transfer board end section, and at least a portion of the second portable transfer board end section to facilitate a substantially flush, rigid alignment between joint ends of the first and second portable transfer board end sections over the narrowed ferrule in an assembled configuration of the portable transfer board, wherein:

in the assembled configuration of the portable transfer board, the first straight tubing segment and the third straight tubing segment extend parallel to the second straight tubing segment and the fourth straight tubing segment at a separation distance of about six inches apart with open space between the first, second, third, and fourth straight tubing segments.

8. The portable transfer board according to claim 7, wherein:

the first U-shaped segment is formed having a gradual tapered transition from an oval tubular cross section at a first longitudinal end of the portable transfer board to a substantially circular cross section at the distal ends of the first straight tubing segment and the second straight tubing segment along the single continuous bend radius; and the second U-shaped segment is formed having the gradual tapered transition from the oval tubular cross section at a second longitudinal end of the portable transfer board to the substantially circular cross section at the distal ends of the third straight tubing segment and the fourth straight tubing segment along the single continuous bend radius.

9. The portable transfer board according to claim 7, wherein:

at least one of the first portable transfer board end section and the second portable transfer board end section comprises a shock cord port, the shock cord port comprising a larger opening and a smaller slot;

the shock cord comprises a large catch positioned on the shock cord proximate to a distal end of the shock cord and a small catch positioned along the shock cord at a distance from the distal end of the shock cord;

the small catch is sized small enough to pass through the large opening but too large to fit through smaller slot; and the large catch is sized too large to fit through either the smaller slot or the larger opening.

10. The portable transfer board according to claim 7, wherein in the assembled configuration of the portable transfer board, the first portable transfer board end section and the second portable transfer board end section are in a single plane and have flush joints.

11. The portable transfer board according to claim 7, wherein in the assembled configuration of the portable transfer board, the portable transfer board has a greater length than width, and the length is about two to four feet.

12. A portable transfer board for transferring a person between a first surface and a second surface, comprising:

a first portable transfer board end section comprising a first straight tubing segment, a second straight tubing segment that extends parallel to the first straight tubing segment, and a first U-shaped segment having a tapered transition and that extends between distal ends of the first straight tubing segment and the second straight tubing segment;

a second portable transfer board end section comprising a third straight tubing segment, a fourth straight tubing segment that extends parallel to the third straight tubing segment, a second U-shaped segment having a tapered transition and that extends between distal ends of the third straight tubing segment and the fourth straight tubing segment, and a narrowed ferrule tube that extends beyond a joint end of at least one of the third straight tubing segment and the fourth straight tubing segment; and a shock cord that extends through the narrowed ferrule, at least a portion of the first portable transfer board end section, and at least a portion of the second portable transfer board end section to facilitate alignment between joint ends of the first and second portable transfer board end sections over the narrowed ferrule in an assembled configuration of the portable transfer board, wherein:

in the assembled configuration of the portable transfer board, the first straight tubing segment and the third straight tubing segment extend parallel to the second straight tubing segment and the fourth straight tubing segment at a separation distance of about six inches apart with open space between the first, second, third, and fourth straight tubing segments.

13. The portable transfer board according to claim 12, wherein the first U-shaped segment and the second U-shaped segment are formed having a single continuous bend radius.

14. The portable transfer board according to claim 13, wherein the first U-shaped segment is formed having a gradual tapered transition from an oval tubular cross section at a first longitudinal end of the portable transfer board to a substantially circular cross section at the distal ends of the first straight tubing segment and the second straight tubing segment along a single continuous bend radius.

15. The portable transfer board according to claim 14, wherein the second U-shaped segment is formed having a gradual tapered transition from the oval tubular cross section at a second longitudinal end of the portable transfer board to the substantially circular cross section at the distal ends of the third straight tubing segment and the fourth straight tubing segment along the single continuous bend radius.

16. The portable transfer board according to claim 12, wherein at least one of the first portable transfer board end section and the second portable transfer board end section comprises a shock cord port, the shock cord port comprising a larger opening and a smaller slot.

17. The portable transfer board according to claim 16, wherein the shock cord comprises a large catch positioned on the shock cord proximate to a distal end of the shock cord and a small catch positioned along the shock cord at a distance from the distal end of the shock cord.

18. The portable transfer board according to claim 17, wherein:

the small catch is sized small enough to pass through the large opening but too large to fit through smaller slot; and the large catch is sized too large to fit through either the smaller slot or the larger opening.

19. The portable transfer board according to claim 12, wherein in the assembled configuration of the portable transfer board, the first portable transfer board end section and the second portable transfer board end section are in a single plane and have flush joints.

20. The portable transfer board according to claim 12, wherein in the assembled configuration of the portable transfer board, the portable transfer board has a greater length than width, and the length is about two to four feet.

* * * * *